US009895279B2

(12) United States Patent
Juto et al.

(10) Patent No.: US 9,895,279 B2
(45) **Date of Patent: *Feb. 20, 2018**

(54) STIMULATION OF HYPOTHALAMUS

(71) Applicant: CHORDATE MEDICAL AB, Kista (SE)

(72) Inventors: Jan-Erik Juto, Stockholm (SE); Fredrik Juto, Stockholm (SE)

(73) Assignee: CHORDATE MEDICAL AB, Kista (SE)

( * ) Notice: Subject to any disclaimer, the term of this patent is extended or adjusted under 35 U.S.C. 154(b) by 322 days.

This patent is subject to a terminal disclaimer.

(21) Appl. No.: 13/714,612

(22) Filed: Dec. 14, 2012

(65) Prior Publication Data

US 2013/0158448 A1 Jun. 20, 2013

Related U.S. Application Data

(60) Provisional application No. 61/576,848, filed on Dec. 16, 2011.

(30) Foreign Application Priority Data

Dec. 16, 2011 (EP) ..... 11194010

(51) Int. Cl.
*A61H 21/00* (2006.01)
*A61H 23/04* (2006.01)
(Continued)

(52) U.S. Cl.
CPC ..... *A61H 1/00* (2013.01); *A61H 9/0078* (2013.01); *A61H 21/00* (2013.01); *A61H 23/02* (2013.01);
(Continued)

(58) Field of Classification Search
CPC ..... A61H 9/0078; A61H 23/04; A61H 21/00; A61H 2230/505; A61H 2230/045;
(Continued)

(56) References Cited

U.S. PATENT DOCUMENTS 901,376 A 10/1908 Roberts
912,205 A 2/1909 Talcott
(Continued)

FOREIGN PATENT DOCUMENTS

CH 329193 A 4/1958
EP 0935980 A1 8/1999
(Continued)

OTHER PUBLICATIONS

Papon et al., "Nasal wall compliance in vasomotor rhinitis," J. Appl. Physiol., vol. 100, 2006 (First published Sep. 1, 2005), pp. 107-111, XP055055268.
(Continued)

*Primary Examiner* — Valerie L Woodward
*Assistant Examiner* — Douglas Sul
(74) *Attorney, Agent, or Firm* — Birch, Stewart, Kolasch & Birch, LLP

(57) ABSTRACT

A method for stimulating the hypothalamus in a human subject is provided. The method includes the step of imparting vibrations to a posterior part of a nasal cavity of the human subject by a device for stimulation of the hypothalamus, which includes an expandable stimulation member arranged to stimulate hypothalamic activity.

17 Claims, 11 Drawing Sheets

(51) Int. Cl.

| | |
|---|---|
| ***A61H 1/00*** | (2006.01) |
| ***A61H 9/00*** | (2006.01) |
| ***A61H 23/02*** | (2006.01) |

(52) U.S. Cl.

CPC ..... *A61H 23/04* (2013.01); *A61H 2201/0103* (2013.01); *A61H 2201/5071* (2013.01); *A61H 2205/023* (2013.01); *A61H 2230/045* (2013.01); *A61H 2230/065* (2013.01); *A61H 2230/105* (2013.01); *A61H 2230/505* (2013.01)

(58) Field of Classification Search

CPC ..... A61H 2230/065; A61H 2230/101; A61H 2201/123; A61H 2201/5071; A61N 1/0529; A61N 1/0534; A61N 2001/36039; A61N 1/36071; A61N 2001/36075

See application file for complete search history.

(56) References Cited

U.S. PATENT DOCUMENTS

| | | | | |
|---|---|---|---|---|
| 961,034 | A | 6/1910 | Siebert et al. | |
| 1,735,519 | A | 11/1929 | Vance | |
| 1,764,838 | A | 6/1930 | Horne | |
| 2,052,321 | A * | 8/1936 | Smart | 604/94.01 |
| 2,101,273 | A | 12/1937 | Smith | |
| 3,612,211 | A | 10/1971 | Clark, III | |
| 3,848,607 | A | 11/1974 | St Clair | |
| 4,462,411 | A | 7/1984 | Rickards | |
| 4,911,149 | A | 3/1990 | Borodulin et al. | |
| 5,139,510 | A | 8/1992 | Goldsmith, III et al. | |
| 5,609,606 | A | 3/1997 | O'Boyle | |
| 5,682,881 | A | 11/1997 | Winthrop et al. | |
| 5,903,516 | A | 5/1999 | Greenleaf et al. | |
| 6,159,170 | A | 12/2000 | Borodulin et al. | |
| 6,193,680 | B1 | 2/2001 | Parsons et al. | |
| 6,230,049 | B1 | 5/2001 | Fischell et al. | |
| 6,358,272 | B1 | 3/2002 | Wilden | |
| 6,709,406 | B2 * | 3/2004 | Laserow | 600/552 |
| 7,640,062 | B2 * | 12/2009 | Shalev | A61N 1/3605 607/1 |
| 8,317,816 | B2 | 11/2012 | Becker | |
| 2001/0051819 | A1 | 12/2001 | Fischell et al. | |
| 2002/0072781 | A1 | 6/2002 | Lattner et al. | |
| 2002/0177889 | A1 | 11/2002 | Brisken et al. | |
| 2003/0087734 | A1 | 5/2003 | Kring et al. | |
| 2003/0195578 | A1 * | 10/2003 | Perron et al. | 607/27 |
| 2004/0096089 | A1 * | 5/2004 | Borsook et al. | 382/131 |
| 2004/0097850 | A1 | 5/2004 | Plante | |
| 2004/0138536 | A1 * | 7/2004 | Frei et al. | 600/300 |
| 2004/0172112 | A1 | 9/2004 | Cioanta et al. | |
| 2004/0220644 | A1 * | 11/2004 | Shalev et al. | 607/45 |
| 2004/0230252 | A1 | 11/2004 | Kullok et al. | |
| 2004/0243172 | A1 | 12/2004 | Hogle | |
| 2005/0011518 | A1 | 1/2005 | Biondo et al. | |
| 2005/0021092 | A1 | 1/2005 | Yun et al. | |
| 2005/0054958 | A1 | 3/2005 | Hoffmann | |
| 2006/0094992 | A1 | 5/2006 | Imboden et al. | |
| 2006/0190022 | A1 | 8/2006 | Beyar et al. | |
| 2007/0149905 | A1 | 6/2007 | Hanna | |
| 2008/0027487 | A1 * | 1/2008 | Patel et al. | 607/2 |
| 2008/0198330 | A1 | 8/2008 | Taylor | |
| 2008/0200848 | A1 | 8/2008 | Avni | |
| 2008/0208168 | A1 | 8/2008 | Garabet | |
| 2008/0243204 | A1 * | 10/2008 | Uthman et al. | 607/45 |
| 2008/0281238 | A1 | 11/2008 | Oohashi et al. | |
| 2009/0005713 | A1 | 1/2009 | Podrazhansky et al. | |
| 2009/0118786 | A1 * | 5/2009 | Meadows | A61B 5/1126 607/45 |
| 2009/0157141 | A1 * | 6/2009 | Chiao et al. | 607/46 |
| 2009/0187098 | A1 | 7/2009 | Makower et al. | |
| 2010/0004709 | A1 | 1/2010 | Mische | |
| 2010/0094209 | A1 | 4/2010 | Drasler et al. | |
| 2010/0228075 | A1 | 9/2010 | Lu | |
| 2010/0234840 | A1 | 9/2010 | Jackson et al. | |
| 2010/0249637 | A1 | 9/2010 | Walter et al. | |
| 2010/0286576 | A1 | 11/2010 | Pryor et al. | |
| 2010/0286626 | A1 | 11/2010 | Petersen et al. | |
| 2011/0190668 | A1 | 8/2011 | Mishelevich | |
| 2011/0270138 | A1 | 11/2011 | Mishelevich | |

FOREIGN PATENT DOCUMENTS

| | | | |
|---|---|---|---|
| FR | 592104 | A | 7/1925 |
| FR | 838034 | A | 2/1939 |
| FR | 920885 | A | 4/1947 |
| GB | 385992 | A | 1/1933 |
| GB | 1217760 | A | 12/1970 |
| JP | 2001-17500 | A | 1/2001 |
| JP | 2001-37883 | A | 2/2001 |
| KR | 10-1019957 | B1 | 3/2011 |
| RU | 2099039 | C1 | 12/1997 |
| RU | 2199303 | C1 | 2/2003 |
| SU | 1148614 | A | 4/1985 |
| SU | 1560205 | A1 | 4/1990 |
| WO | WO 86/01399 | A1 | 3/1986 |
| WO | WO 96/36396 | A2 | 11/1996 |
| WO | WO 96/39218 | A1 | 12/1996 |
| WO | WO 01/41695 | A2 | 6/2001 |
| WO | WO 2004/047675 | A2 | 6/2004 |
| WO | WO 2004/105579 | A2 | 12/2004 |
| WO | WO 2006/114783 | A2 | 11/2006 |
| WO | WO 2008/138997 | A1 | 11/2008 |
| WO | WO 2010/033055 | A1 | 3/2010 |

OTHER PUBLICATIONS

Alstadhaug, "Migraine and the Hypothalamus", Cephalalgia, 2009, pp. 1-9.

Ansarinia et al., "Electrical Stimulation of Sphenopalatine Ganglion for Acute Treatment of Cluster Headaches", Headache, Jul. 2010, pp. 1164-1174.

Bar-Shir et al., "Late Stimulation of the Sphenopalatine-Ganglion in Ischemic Rats: Improvement in N-Acetyl-Aspartate Levels and Diffusion Weighted Imaging Characteristics as Seen by MR", Journal of Magnetic Resonance Imaging, vol. 31, 2010, pp. 1355-1363.

Brown et al., "Towards a Physiology-Based Measure of Pain: Patterns of Human Brain Activity Distinguish Painful from Non-Painful Thermal Stimulation", Plos One, vol. 6, Iss. 9, e24124, Sep. 2011, pp. 1-8.

Kim et al., "Predicting the Timing of Spikes Evoked by Tactile Stimulation of the Hand", J Neurophysiol, vol. 104, 2010, pp. 1484-1496.

Krajnak et al., "Characterization of Frequency-Dependent Responses of the Vascular System to Repetitive Vibration", JOEM, vol. 52, No. 6, Jun. 2010, pp. 584-594.

Kuncel et al., "Selection of Stimulus Parameters for Deep Brain Stimulation", Clinical Neurophysiology, vol. 115, 2004, pp. 2431-2441.

Leroux et al., "Cluster Headache", Orphanet Journal of Rare Diseases, vol. 3, No. 20, 2008, 11 pages provided.

Ludwig, "The Velocity of Sound through Tissues and the Acoustic Impedance of Tissues", The Journal of the Acoustical Society of America, vol. 22, No. 6, Nov. 1950, 5 pages provided.

Malm, "Measurement of Nasal Patency", Allergy, vol. 52 (suppl. 40), 1997, pp. 19-23.

Malm, "Stimulation of Sympathetic Nerve Fibres to the Nose in Cats", Acta Otolaryng, vol. 75, 1973, pp. 519-526.

Salansky et al., "Responses of the Nervous System to Low Frequency Stimulation and EEG Rhythms: Clinical Implications", Neuroscience and Biobehavioral Reviews, vol. 22, No. 3, 1998, pp. 395-409.

Tepper et al., "Acute Treatment of Intractable Migraine With Sphenopalatine Ganglion Electrical Stimulation", Headache, vol. 49, Jul. 2009, pp. 983-989.

VBM, "VBM Tube Fixations", VBM Medizintechnik GmbH, 2006, 6 pages provided.

(56) References Cited

OTHER PUBLICATIONS

Zelena, "Nerves and Mechanoreceptors: The Role of Innervations in the Development and Maintenance of Mammalian Mechanoreceptors", Springer, 1994, pp. 147-148.
U.S. Appl. No. 13/714,643, filed Dec. 14, 2012.
U.S. Appl. No. 13/714,634, filed Dec. 14, 2012.
U.S. Appl. No. 13/714,636, filed Dec. 14, 2012.
U.S. Appl. No. 13/714,726, filed Dec. 14, 2012.
U.S. Appl. No. 13/714,649, filed Dec. 14, 2012.
Klinger et al., "Untersuchungen zur Mikro-zirkulation der Nasenschleimhaut bei Verwendung von Ballon-tamponaden", Laryngo-Rhino-Otol., vol. 76, 1997, pp. 127-130, XP008066107.

* cited by examiner

STIMULATION OF HYPOTHALAMUS

CROSS-REFERENCE TO RELATED APPLICATIONS

This application claims priority under 35 U.S.C. § 119(e) to U.S. Provisional Application No. 61/576,848 filed on Dec. 16, 2011. This application also claims priority under 35 U.S.C. § 119(a) to Application No. 11194010.2, filed in Europe on Dec. 16, 2011. The entirety of each of the above-identified applications is expressly incorporated herein by reference.

BACKGROUND OF THE INVENTION

1. Field of the Invention

The present invention relates to devices and methods for stimulation of hypothalamic activity in a human subject by imparting vibrations to the posterior part of the nasal cavity of the human subject.

2. Description of Background Art

The hypothalamus is a portion of the brain which lies beneath the thalamus and which contains a number of small nuclei with a variety of functions. One of the most important functions of the hypothalamus is to provide a link between the nervous system and the endocrine system via the pituitary gland (hypophysis). The hypothalamus has an influence on certain metabolic processes by secreting certain neurohormones, often called hypothalamic-releasing hormones, which in turn stimulate or inhibit the secretion of pituitary hormones. It also regulates other glands such as the ovaries, parathyroids and thyroid and has a degree of control over sleeping patterns, eating, drinking and speech. Moreover, the hypothalamus is involved in the regulation of body temperature, water balance, blood sugar and fat metabolism. Several illnesses are associated with hypothalamic dysfunction, such as migraine, Ménière's disease, hypertension, cluster headache, arrhythmia, ALS, irritable bowel syndrome, sleep disorders, diabetes, obesity, multiple sclerosis, tinnitus, Alzheimer's disease, mood and anxiety disorders and epilepsy. In many cases the connection between the hypothalamus and the illness in question is not fully understood. In addition, many of the illnesses listed above lack satisfactory therapies.

Ménière's disease (MD), for example, is a relatively rare disease affecting the inner ear. The disease is characterized by episodic vertigo, fluctuating hearing loss, aural pressure and tinnitus. MD is a progressive disorder that most often results in severe hearing deterioration. No otoprotective interventions currently exist and chemical or surgically destructive procedures are used for treatment beyond the acute phase.

Cluster headache (CH), also called Horton's headache, is another example of an illness with a suggested connection to hypothalamus and which lacks a successful treatment method. CH is the most severe disorder among primary headache disorders. It is characterized by recurrent short-lasting attacks of torturous unilateral periorbital pain, mostly accompanied by ipsilateral autonomic signs such as nasal congestion, ptosis, lacrimation and redness of the eye. Ipsilateral autonomic signs are signs of autonomic dysfunction; ipsilateral lacrimation, redness of the eye and nasal congestion are signs of parasympathetic hyperactivity, and the combination of ptosis and miosis is a sign of sympathetic hypoactivity. New surgical therapies have been tested. However, these treatments are invasive and can cause severe complications. The pathophysiology of CH is currently unknown, but involvement of the hypothalamus and the parasympathetic nervous system has been proposed (Leoux E et al, *Orphanet J of Rare Diseases;* 2008, 3:20)

Yet another example of an illness where involvement of hypothalamus has been suggested is migraine (Alstadhaug K B, *Cephalalgia;* 2009, 29: 809). Migraine is a complex multi-factorial disorder of the brain that is characterized by episodes of headache and super-sensitivity to sensory stimuli. Migraine is a type of primary headache disorder, and can be broadly categorized as migraine without aura and migraine with aura. The clinical features in migraine are thought to result from dysfunction of the parasympathetic nervous system.

There are several known devices for conducting treatments with systemic effects in patients. Devices for use in for example the nasal cavity however often aim at achieving a local effect, such as decongesting the nasal mucosa, and may often be used in combination with a chemical substance. One example of a device for achieving a local effect on the nasal mucosa is disclosed in WO 2008/138997.

Devices are also known that by mechanical vibration in a body cavity affect body functions. In US 2008/0281238, a system for increasing activity in the fundamental brain is disclosed. The disclosed system comprises a first and a second vibration applying device, wherein the first vibration applying device applies vibrations having frequency components within an audible range to the auditory sense system of a living body. The second vibration applying device applies vibrations having super-high frequency components exceeding the audible range to another region than the auditory sense system, such as the nasal cavity.

In RU 2199303 there is disclosed a method of treating the neuroautonomic form of vasomotor rhinitis. More specifically, the method involves vibratory massage of the anterior third of the inferior and middle conchae at a frequency of 50 Hz for 1.5-2 minutes in combination with vibratory massage of certain biological active points (BAP:s) located in the hand, chin and near the nose. The instrument used for delivering the vibratory massage is described as a vibro-massage instrument having a ball and a tip.

SUMMARY OF THE INVENTION

It is an object of the present invention to provide novel methods and devices for treatment of diseases related to hypothalamic dysfunction.

There is, in a first aspect of the present invention, provided a device for stimulation of the hypothalamus in a human subject, comprising an expandable stimulation member arranged to stimulate hypothalamic activity by imparting vibrations to a posterior part of a nasal cavity of the human subject; an expansion member arranged to expand the stimulation member, wherein the expansion member comprises a tubular structure arranged at least partly within the stimulation member, wherein the tubular structure is provided with a plurality of openings arranged for fluid communication with the stimulation member; and a vibration member connected to the expansion member and arranged to bring the stimulation member to vibrate.

Vibratory stimulation in the posterior part of the nasal cavity with a device according to the first aspect thus affects hypothalamic activity. The activity in hypothalamus can be measured directly or indirectly by different qualitative and/or quantitative methods. In particular, changes in physiological parameters such as for example blood flow, oxygen consumption and metabolic activity are correlated to changes in the level of hypothalamic activity. Such physiological parameters can thus be used as measures of hypothalamic activity. Some measures allow the hypothalamic activity to be monitored directly, such as by means of functional neuroimaging; and some indirectly, such as by means of different bodily responses, e.g. pupil size and heart activity.

Depending on the present health condition of a patient treated with a device according to the first aspect, stimulation may alter the level of activity in hypothalamus somewhat differently. If for example a patient suffering from a medical condition associated with an abnormal activity in the hypothalamus is treated with a device according to the first aspect, stimulation may result in normalized hypothalamic activity. Normalization in this context may refer to a condition where the hypothalamic activity is comparable to the activity in surrounding brain tissue. High oxygen consumption in the hypothalamus has for example been observed in patients suffering from migraine during their migraine attacks. Stimulation with a device according to the first aspect may reduce oxygen consumption in the patient's hypothalamus; end the migraine attack and thus revert the patient to a normal and healthy condition.

The device according to the first aspect is arranged to impart vibrations to the posterior part of the nasal cavity. More specifically, the device of the first aspect may be arranged to impart vibratory stimulation to bone structures in the nasal cavity, such as parts of the inferior, middle and/or superior chonchae, e.g. posterior two thirds of the inferior and middle conchae. The middle and superior conchae are attached to the scull base and thus vibrations imparted to the middle and superior conchae may be mechanically transmitted to the hypothalamus.

The device according to the first aspect is specifically adapted for vibratory stimulation of the posterior part of the nasal cavity. The tubular structure of the expansion member is provided with a plurality of openings for fluid communication with the interior of the stimulation member. These openings ensure that the stimulation member is expanded accordingly when positioned in the posterior part of the nasal cavity, even if there is an obstruction somewhere along the length of the stimulation member due to the complex anatomy of the nasal cavity. The plurality of openings moreover provides the tubular structure with flexibility which facilitates correct insertion and positioning of the stimulation member in the posterior part of the nasal cavity. The stimulation member is preferably introduced into the nasal cavity in a non-expanded state.

In one embodiment, the expansion member further comprises an elongated structure arranged in fluid communication with the tubular structure, wherein the elongated structure is preferably arranged essentially outside the stimulation member.

In one embodiment, the stimulation member is arranged to abut against the tissue of the posterior part of the nasal cavity. Thus, the stimulation member provides direct contact with the tissue of the posterior part of the nasal cavity. Moreover, the stimulation member can be arranged to abut against a tissue of the posterior part of the nasal cavity at a pressure of between approximately 70 and 120 mbar, such as for example between approximately 70 and 110 mbar, such as between approximately 80 and 110 mbar, such as between approximately 90 and 105 mbar, and for example between approximately 75 and 100 mbar.

The stimulation member may, in another embodiment, be arranged to impart vibrations at a frequency of between 40 and 100 Hz to the posterior part of the nasal cavity. Thus, it should be understood that vibratory stimulation may be performed at one selected frequency, e.g. 68 Hz, or at several frequencies within a predetermined frequency interval, such as between approximately 50 and 80 Hz, such as between approximately 50 and 75 Hz, such as between approximately 50 and 70 Hz, such as between approximately 55 and 75 Hz, such as between approximately 60 and 75 Hz, and such as between approximately 60 and 70 Hz.

In one embodiment, the stimulation member is arranged to affect the hypothalamus and not the nasal cavity. Thus, the device may provide vibratory stimulation to the posterior part of the nasal cavity to selectively stimulate hypothalamus while no, or at least minimal effects of the vibratory stimulation in, for example, the anterior part of the nasal cavity of the human subject can be ascertained. Such selective hypothalamus stimulation may for example be accomplished by providing vibratory stimulation to bone structures connected to the cranium, e.g. parts of the middle concha and/or the superior concha.

In one embodiment, a bending stiffness of the tubular structure in a first direction essentially perpendicular to a longitudinal direction of the tubular structure is different from a bending stiffness in a second direction essentially perpendicular to the first direction and to the longitudinal direction of the tubular structure. The tubular structure is thus sufficiently resilient to follow the, sometimes irregular, shape of the nasal cavity in the sagittal plane. At the same time, accidental bending in a lateral direction during the introduction into the nose may be avoided.

In one embodiment, the tubular structure of the expansion member has one opening at one end, said one opening being arranged freely within and in fluid communication with an interior of the stimulation member. A free arrangement of the end opening may facilitate preservation of a smooth surface of the stimulation member, by avoiding protruding parts that may harm the sensitive tissue in the nasal cavity.

In one embodiment, a distance from said end of the tubular structure of the expansion member to an inner wall within the stimulation member is comprised in the range of from approximately 1 to approximately 10 mm. This distance may be essentially unchanged when the stimulation member is expanded. In some examples where the stimulation member is elastic, this distance may refer to the distance to an inner wall of the stimulation member when the stimulation member is arranged in an expanded state, also referred to below as a second state.

In one embodiment, the plurality of openings are distributed along a longitudinal direction of the tubular structure. The plurality of openings may for example be arranged alternately on opposite side portions of the tubular structure along the longitudinal direction, wherein a cross section of the tubular structure perpendicular to the longitudinal direction intersects only one opening of either side. The number of openings distributed along a longitudinal direction of the tubular structure may be between 4 and 6, such as 5. The plurality of openings, which may be elliptic cutouts, may independently have a size in the range of from approximately 1 to approximately 5 mm. Thus, all openings need not have the same size or shape.

In one embodiment, the tubular structure of the expansion member has an outer diameter in the range of from approximately 1 to approximately 5 mm, such as from approximately 2 to approximately 4 mm. A diameter of approximately 5 mm or less may further facilitate introduction into the nostril and nasal cavity and positioning in the posterior part of the nasal cavity.

In one embodiment, the elongated structure of the expansion member is tubular and has a diameter that is between 2 to 4 times the diameter of the tubular structure of the expansion member. Thus, the tubular structure, which is the part of the expansion member that will be positioned mainly in the nasal cavity during vibratory stimulation, has a smaller diameter than the elongated structure, which is the part of the expansion member that will be positioned mainly outside of the nasal cavity.

In one embodiment, the part of said tubular structure being arranged within the stimulation member is between approximately 40 and approximately 60 mm in length. This length of the tubular structure may further facilitate insertion and positioning of the stimulation member in the posterior part of the nasal cavity.

In one embodiment, a part of the elongated structure of the expansion member is arranged within the stimulation member, said part having a length of from approximately 5 to approximately 15 mm. This part of the elongated structure may enclose an ending of the tubular structure, preferably an end portion of the tubular structure. The stimulation member arranged around this part of the elongated structure may preferably expand only to a small extent when the device is in use.

In one embodiment, the device further comprises a visual marking indicating a preferred angular orientation of the stimulation member relative the nasal cavity for introduction of the stimulation member into the nasal cavity. Such a visual marking facilitates insertion into the nasal cavity.

In one embodiment, the stimulation member further comprises a stimulating portion arranged to abut against the tissue of the posterior part of the nasal cavity; and a retaining portion arranged to abut against the tissue of the anterior part of the nasal cavity, wherein the stimulating portion is arranged to stimulate the hypothalamus by imparting vibrations to the posterior part of the nasal cavity. The stimulating portion is thus arranged to impart vibrations to the posterior part of the nasal cavity in order to achieve stimulation of hypothalamus, whereas the retaining portion may be arranged to retain the stimulation member at a fixed position in the nasal cavity during vibratory stimulation without imparting vibrations to surrounding tissue.

In one embodiment, the retaining portion comprises a part of the elongated structure of the expansion member being arranged within the stimulation member. The retaining portion may thus comprise at least a part of the elongated structure and a part of the stimulation member. This part of the elongated structure may have a size, i.e. diameter, which enables retaining of the stimulation member in an outer part of the nasal cavity such as the nostril. Alternatively, the elongated structure in combination with an at least partly expanded stimulation member enables retaining in an outer part of the nasal cavity such as the nostril.

In one embodiment, the expansion member comprises at least one channel arranged for fluid communication with the stimulation member, such as for supplying fluid to the stimulation member. In embodiments where the expansion member comprises a tubular structure and an elongated structure, the channel fluidly connects the two structures with each other and with an interior of the stimulation member.

In one embodiment, the stimulation member is arrangeable in a first state wherein the stimulation member can be introduced into the nasal cavity of a human subject, and a second state wherein the stimulation member is expanded to a volume such that the stimulation member is adapted to abut against the tissue of the posterior part of the nasal cavity.

Other device aspects of the invention include a device for stimulation of hypothalamus in a human subject, comprising a stimulation member arranged to stimulate hypothalamic activity by imparting vibrations to the posterior part of the nasal cavity of the human subject.

A further device aspect provide a device for stimulation of hypothalamus in a human subject, comprising an expandable stimulation member arranged to stimulate hypothalamic activity by imparting vibrations to the posterior part of the nasal cavity of the human subject, and an expansion member arranged to expand the stimulation member, wherein the expansion member comprises a tubular structure arranged at least partly within the stimulation member, wherein the tubular structure is provided with at least one opening arranged for fluid communication with the stimulation member, and an elongated structure arranged in fluid communication with the tubular structure, wherein the elongated structure of the expansion member is tubular and has a diameter that is between 2 to 4 times the diameter of the tubular structure of the expansion member.

In one embodiment, the device further comprises a vibration member arranged to bring the stimulation member to vibrate and wherein the stimulation member is expandable and can be arranged in a first state wherein the stimulation member can be introduced into the nasal cavity of a human subject, and a second state wherein the stimulation member is expanded to a volume such that the stimulation member abuts against the tissue of the posterior part of the nasal cavity. In the first state, the stimulation member is arranged in an essentially non-expanded state such as to facilitate introduction into the nostril and nasal cavity of a human being. In the second state, the stimulation member is expanded to a volume such as to provide a direct contact with the surrounding tissue of the posterior part of the nasal cavity. The expansion may for example be provided by an expansion member arranged to expand the stimulation member to the second state. This expansion may be accomplished by means of a fluid supplied to the stimulation member, accordingly arranged to encompass such fluid. When expanded in the posterior part of the nasal cavity, the stimulation member is brought to vibrate by means of the vibration member. Vibrations may for example be transferred to the tissue by pumping fluid in and out of the stimulation member.

In one embodiment, the stimulation member is expandable and the device for stimulation of hypothalamus further comprises an expansion member arranged to expand the stimulation member. The expansion member preferably comprises at least one channel for supplying fluid to the stimulation member, which achieves said expansion. The stimulation member is for example arranged to partly surround the expansion member, such that the expansion member is at least partly arranged within the stimulation member.

It should be understood that embodiments disclosed in relation to one aspects of the present invention are, where applicable, relevant also to other aspects of the invention.

In a another aspect, there is provided a system for stimulation of the hypothalamus in a human subject by imparting vibrations to the posterior part of the nasal cavity of a human subject, comprising a device according to a device aspect of the present invention, such as the first aspect; a data collection module arranged to obtain time samples of an input signal reflecting a measure of hypothalamic activity; a memory module arranged to store at least one previously obtained time sample of the input signal; an analyzing module arranged to process the input signal and the previously obtained time sample; and at least one of a frequency regulating module arranged to adjust a frequency of the vibrations imparted by the stimulation member of the device to the posterior part of the nasal cavity; an amplitude regulating module arranged to adjust an amplitude of the vibrations imparted by the stimulation member to the posterior part of the nasal cavity, and a pressure regulating module arranged to adjust a pressure at which the stimulation member abuts the tissue of the posterior part of the nasal cavity.

It should be understood that the embodiments disclosed in relation to other aspects of the present invention are, where applicable, relevant also to the system aspect of the invention. Thus, the system may for example comprise a device according to individual embodiments as defined in the device aspect.

A time sample should be understood as at least one measured or recorded value at a particular point in time. A time sample can comprise one or several of: a value of the input signal, the frequency of vibrations being imparted by the stimulation member, the amplitude of vibrations being imparted by the stimulation member, and/or the pressure at which the stimulation member abuts the tissue, and the amount of time elapsed since start of treatment.

In a system according to the above described system aspect, at least one of the parameters vibration frequency, vibration amplitude and abutting pressure may be independently regulated. Exemplary ranges for vibration frequency and pressure are disclosed in connection with the device aspect. The regulating modules of the system may be controlled manually or by means of a control unit. The system may for example comprise at least two regulating modules selected from a frequency regulating module, an amplitude regulating module and a pressure regulating module. In another example, the system comprises a frequency regulating module, an amplitude regulating module and a pressure regulating module.

In one embodiment, the analyzing module is arranged to terminate stimulation in the posterior part of the nasal cavity when the input signal reflecting a measure of hypothalamic activity has reached a first threshold. The analyzing module thus compares the input signal to the first threshold and issues a command to terminate the stimulation in the nasal cavity when the first threshold is surpassed. Thus, reaching of the threshold represents the attainment of a desired level of hypothalamic stimulation and indicates that the stimulation should be terminated. The first threshold may be predetermined or calculated, in absolute or relative terms. For example, the first threshold of hypothalamic activity may be defined in relative or absolute terms as corresponding to the level of activity of the parts of the brain surrounding hypothalamus.

Some patients might however require further hypothalamic stimulation by administration of vibrations in a second nasal cavity. Thus, in another embodiment, the analyzing module is arranged to terminate the stimulation in a first nasal cavity and to propose stimulation of the posterior part of a second nasal cavity when the measure of hypothalamic activity has reached a second threshold. In contrast to the first threshold, the second threshold represents a level of hypothalamic activity where the stimulation should be terminated in a first nasal cavity and continued in a second nasal cavity. Thus, the stimulation in a first nasal cavity may have reached a saturation level where continued stimulation in the same nasal cavity is of no further benefit to the patient. In such a case, the second threshold signals that the stimulation should be continued in the second nasal cavity of the patient. In similarity to the first threshold, the second threshold may reflect a certain level of the rate of change of the measure of the hypothalamic activity.

In one embodiment, the memory module is further arranged to store a history of previously obtained time samples of the input signal, and at least one of applied frequency, applied amplitude, and applied pressure associated with each of the previously obtained values of the input signal in the history. A history of previously obtained time sample may be a plurality of time samples collected continuously during vibration stimulation.

In one embodiment, the analyzing module is further arranged to process said history and identify correlations between changes in the input signal and at least one of frequency, amplitude, and pressure and further to create a database containing said correlations. The processing may comprise identifying periods of roughly constant values of the input signal, followed by an adjustment of one or more of the vibration parameters and a corresponding change in the input signal. From such events a correlation between vibration parameters and input signal may be identified. One example of such a correlation is an increase in the input signal when the pressure is raised. An exemplary way to store these correlations would be in a database where required adjustments of the vibration parameters can be looked up given current input signal value, desired change (e.g. increase or decrease) of the input signal, and current vibration parameters.

Another alternative can for example consist in comparison of two obtained individual values, or time samples, of the input signal. Thus, the analyzing module is, in another embodiment, arranged to compare the input signal with a previously obtained value, or time sample, of the input signal, and to instruct the at least one of the frequency regulating module, the amplitude regulating module and the pressure regulating module to adjust at least one of the frequency, the amplitude and the pressure, if the difference between the input signal and the previously obtained value, or time sample, lies within a threshold tolerance. This threshold tolerance can be defined as the smallest required change in the input signal reflecting a measure of hypothalamic activity for a certain stimulation setting. As can be understood, dependent on a particular desired effect on hypothalamic activity, the threshold tolerance can be defined somewhat differently. The threshold tolerance may e.g. be predetermined, calculated or derived during stimulation of hypothalamus in a human subject and may be expressed in absolute or relative terms.

The previous and later value, or time sample, can for example be two consecutively obtained values of the input signal. Alternatively, the previously obtained value can, for instance, be defined as the average over the last n number of samples, where n is an integer; as a weighted average over all previously obtained values, or as a function of the previous and later obtained values. The previous value(s) are stored in the memory module.

If the difference between the previous and later obtained values is too small, i.e. lies within the threshold tolerance, or has the wrong sign, at least one of the frequency, the amplitude and the pressure is adjusted. Adjustments of the abovementioned parameters can for example be made randomly until the difference in the input signal is as desired, or systematically by applying settings from a pre-defined grid or by applying a heuristic search. Alternatively, previous parameter settings can be stored together with corresponding obtained values in the memory module and a direction in a multidimensional parameter space along which the hypothalamic activity changes the most can be identified. Subsequently, new parameter settings along the identified direction may be tested. In one embodiment, the adjustment may be performed using a method selected from: a random adjustment; an adjustment calculated from a pre-programmed look-up table comprising correlations between desired activity level changes and at least one of frequency, amplitude, and pressure, and an adjustment calculated from the database containing correlations identified by the analyzing module. Adjusting the above mentioned parameters in such a structured manner may simplify and optimize attainment of a desired level of hypothalamic activity.

In one embodiment, the analyzing module is further arranged to determine if the input signal is approaching a desired value reflecting a desired level of hypothalamic activity, said determination comprising comparing the difference between the input signal and the desired value with the difference between the previously obtained value, or time sample, and the desired value, and if it is determined that the target measure is not approached, to instruct the at least one of the frequency regulating module, the amplitude regulating module and the pressure regulating module to adjust at least one of the frequency, the amplitude and the pressure using a method selected from: a random adjustment; an adjustment calculated by applying settings from a pre-defined grid, an adjustment calculated by applying a heuristic search, an adjustment calculated from a look-up table comprising correlations between desired activity level changes and at least one of frequency, amplitude, and pressure; and an adjustment calculated from the database containing correlations identified by the analyzing module. In this way the treatment can be adapted to individual differences present among humans. The vibration parameters that achieves a desired hypothalamic activity in one patient might have to be adjusted for another patient. Automating this procedure may lessen the demand on education of the staff performing the vibration stimulation treatment. Furthermore, further knowledge about effective vibration stimulation treatments may be accumulated over time, which may continuously improve the treatment.

In one embodiment, the analyzing module is further arranged to terminate stimulation when a maximum stimulation time period is reached. A maximum stimulation time may be defined as a maximum time period after which the stimulation is terminated irrespective of which activity level has been attained. This can be seen as a way to detect patients that do not respond to treatment as expected and need special attention. The system may successfully apply automatic treatment of patients without intervention from a medical doctor. A trained nurse or similar staff can perform the steps for initiation of the treatment. However, in some cases, the desired activity level cannot be attained within a specified maximum stimulation time period. In such cases, the automatic treatment session can be terminated and a medical professional with a higher level of training may continue with manually controlled treatment or take other action. As discussed in connection with the device aspects, there are different possible measures or estimates of hypothalamic activity. In one embodiment of the system aspect, the measure of hypothalamic activity is obtained by functional neuroimaging. This means that the input signal received by the data collection module thus reflects hypothalamic activity as measured by functional neuroimaging. More specifically, the input signal reflecting a measure of hypothalamic activity may be selected from the group consisting of oxygen consumption as measured by functional Magnetic Resonance Imaging (fMRI), metabolic activity as measured by Positron Emission Tomography (PET), magnetic signals as measured by magnetoencephalography (MEG), and electrical signals as measured with electroencephalo-graphy (EEG). Such measures and monitoring methods are examples of direct measures of hypothalamic activity. It is anticipated that new and improved methods and devices will be developed within the field of functional neuroimaging and that these will be possible to use in aspects of the present invention.

Alternatively, the input signal reflecting a measure of hypothalamic activity may be based on different bodily responses reflecting hypothalamic activity, such as for example a measure selected from the group consisting of heart rate; pupil size; body temperature, pain sensation, and blood pressure. Such measures are generally considered as indirect measures of hypothalamic activity. Pain sensation should be understood as a subjective or an objective estimation of the pain experienced by a patient.

In another embodiment, the system comprises a plurality of geometrically different stimulation members. The plurality of stimulation members may for example differ in shape as well as in length, width and/or diameter. By selection and use of a stimulation member from a plurality of stimulation members, any difference in stimulation due to difference in nasal anatomy are reduced. In embodiments where the system comprises an analyzing module, such a module may moreover be arranged to compare the response received by stimulation of hypothalamus with an expected response range. If the response received does not correspond to the expected range, the analyzing module may prompt e.g. an operator to exchange the stimulation member accordingly.

In other system aspects, there is provided a system for stimulation of hypothalamus in a human subject, comprising a device as defined in accordance with the first aspect of the present invention; a data collection module arranged to obtain an input signal reflecting a measure of hypothalamic activity; and at least one of a frequency regulating module arranged to adjust the frequency of the vibrations imparted by the stimulation member of the device according to the first aspect to the posterior part of the nasal cavity; an amplitude regulating module arranged to adjust the amplitude of the vibrations imparted by the stimulation member to the posterior part of the nasal cavity, and a pressure regulating module arranged to adjust the pressure at which the stimulation member abuts the tissue of the posterior part of the nasal cavity.

In one embodiment, the system further comprises an analyzing module arranged to analyze the input signal reflecting a measure of hypothalamic activity, wherein the analyzing module based on the analysis of the measure of hypothalamic activity, is arranged to instruct at least one of the frequency regulating module, the amplitude regulating module and the pressure regulating module to adjust at least one of the frequency, the amplitude and the pressure. The analysis may for example involve, after a predetermined stimulation time period, comparing the measure of hypothalamic activity with a target level of activity, and adjusting at least one of the above mentioned parameters if the target level of activity is not attained. Another alternative can for example consist in comparison of two obtained individual values of the input signal. Thus, the analyzing module is, in another embodiment, arranged to compare a previously obtained value of the input signal with a later obtained value of the input signal, and to instruct the regulating modules as defined above if the difference between the later obtained value and the previously obtained value lies within a threshold tolerance. This threshold tolerance can be defined as the smallest required change in the input signal reflecting a measure of hypothalamic activity for a certain stimulation setting. As can be understood, dependent on a particular desired effect on hypothalamic activity, the threshold tolerance can be defined somewhat differently. The threshold tolerance may e.g. be predetermined, calculated or derived during stimulation of hypothalamus in a human subject and may be expressed in absolute or relative terms.

It should be understood that embodiments and examples described in relation to the device and system aspects of the present invention are equally relevant, when applicable, to the following method aspects of the present invention.

In a further aspect, there is provided a method for preparing stimulation of hypothalamus in a human subject, comprising introducing the stimulation member of the device according to the first aspect into a nasal cavity of the human subject; selecting a treatment area in the posterior part of the nasal cavity; arranging the stimulation member to abut against the tissue of the selected treatment area, and selecting at least one hypothalamus stimulating frequency. Based on theoretical estimations and/or previously collected data from stimulation of hypothalamus according to the present invention, the method of preparing stimulation may provide e.g. improved positioning of the stimulation member and transferring of vibrations to the hypothalamus, in order to render possible more efficient stimulation of hypothalamus. This may result in a relatively shorter treatment duration. Thus, the method provides preparation and selection of a treatment regime for a human subject. The preparative method may aim at preparing the first and only round of treatment for a particular patient or a second or further round of treatment. If the method concerns preparing a second or further round of treatment for a particular patient, the data, such as the measure of hypothalamic activity and the parameters used, collected during the previous round of treatment may form basis for selection of parameters for the second or further round of treatment.

The treatment area in the posterior part of the nasal cavity may be selected such as to maximize the effects of vibratory stimulation of hypothalamus. Selection of treatment area may be based on theoretical modeling, knowledge of anatomical details for a particular patient, or on results from a previous round of treatment for the particular patient. In some cases, the treatment area may be selected such that certain parts of the bone structures, e.g. parts of the inferior, middle and/or superior conchae, such as the posterior two thirds of the inferior and middle conchae, of the posterior part of the nasal cavity are in contact with the stimulation member.

The preparative method may further comprise selecting a first or second threshold for hypothalamic stimulation. The first and second threshold are defined in the system aspect of the present invention and thus represents a level of activity where the stimulation may be terminated in the first (or second) nasal cavity and optionally continued in a second nasal cavity.

The preparative method may further comprise arranging the stimulation member to abut tissue of the selected treatment area at a pressure of between approximately 70 and 120 mbar, such as for example between approximately 70 and 110 mbar, such as between approximately 80 and 110 mbar, such as between approximately 90 and 105 mbar, for example between approximately 75 and 100 mbar. Furthermore, the hypothalamus stimulating frequency may be selected from a range between 40 and 100 Hz. Specifically, the selected frequency may lie between approximately 50 and 80 Hz, such as for example between approximately 50 and 75 Hz, such as between approximately 50 and 70 Hz, such as for example between approximately 60 and 75 Hz, and such as between approximately 60 and 70 Hz.

In a further method aspect, there is provided a method for stimulating the hypothalamus in a human subject, comprising the step of imparting vibrations to a posterior part of a nasal cavity of a human subject. Thus, the activity in hypothalamus may be affected by the stimulating method. In addition and as described above, several diseases are characterized by a dysfunction in the hypothalamus. By providing hypothalamus stimulating vibratory treatment in the posterior part of at least a first nasal cavity of the human subject, the method may thus provide an alternative treatment therapy for patients suffering from a disease characterized by a dysfunction in the hypothalamus such as for example migraine, Ménière's disease, hypertension, cluster headache, arrhythmia, ALS, irritable bowel syndrome, sleep disorders, diabetes, obesity, multiple sclerosis, tinnitus, Alzheimer's disease, mood and anxiety disorders and epilepsy.

The vibratory stimulation may further comprise the step of imparting vibrations at at least one frequency selected from the range of approximately 40 to 100 Hz. The stimulation method may furthermore comprise the step of exerting a pressure of between approximately 70 and 120 mbar on the tissue of the posterior part of the nasal cavity. Further examples of vibratory frequencies and pressures are as disclosed in connection with the device aspects of the present invention.

The method may furthermore comprise the steps of obtaining an input signal reflecting a measure of hypothalamic activity; and adjusting at least one of a frequency of the vibrations imparted to the posterior part of the nasal cavity; an amplitude of the vibrations imparted to the posterior part of the nasal cavity, and a pressure exerted on the tissue of the posterior part of the nasal cavity.

In one embodiment, the method further comprises the steps of obtaining an input signal reflecting a measure of hypothalamic activity; and storing consecutive time samples of said input signal together with at least one of a frequency of the vibrations imparted to the posterior part of the nasal cavity, an amplitude of the vibrations imparted to the posterior part of the nasal cavity, and a pressure exerted on the tissue of the posterior part of the nasal cavity.

In one embodiment, the method further comprises the step of terminating the vibratory stimulation in the posterior part of the nasal cavity when the input signal reflecting a measure of hypothalamic activity has reached a first threshold. The method may furthermore comprise, wherein the nasal cavity is a first nasal cavity, the step of imparting vibrations to a posterior part of a second nasal cavity of the human subject when the input signal reflecting a measure of hypothalamic activity has reached a second threshold for stimulation in the first nasal cavity. Thus, vibration stimulation is terminated in a first nasal cavity and continued in a second nasal cavity when the second threshold is attained. The first and second thresholds of the method aspect are similarly defined as the first and second thresholds of the system aspect.

In another embodiment, the method comprises analyzing the input signal reflecting a measure of hypothalamic activity and adjusting at least one of the frequency, the amplitude and the pressure based on the analysis of the measure of hypothalamic activity. In one embodiment, the method further comprises the steps of comparing the input signal with a previously obtained value, or time sample, of the input signal, and adjusting at least one of frequency, amplitude and pressure, if the difference between the later obtained value and the previously obtained value lies within a threshold tolerance. The previously obtained value, the threshold tolerance and adjustment strategies are as defined in connection with the system aspect of the present invention. Said adjusting may for example be performed using a method selected from a random adjustment; an adjustment calculated by applying settings from a pre-defined grid; an adjustment calculated by applying a heuristic search; an adjustment calculated from a pre-programmed look-up table comprising correlations between desired activity level changes and at least one of frequency, amplitude, and pressure; and an adjustment calculated by identifying correlations between changes in the stored time samples and changes in the stored at least one of frequency, amplitude, and pressure.

In one embodiment, the method further comprises the steps of determining if the input signal is approaching a desired value reflecting a desired level of hypothalamic activity, said determination comprising comparing the difference between the input signal and the desired value with the difference between the previous time sample and the desired value; and if it is determined that the desired value is not approached, adjusting at least one of the frequency, the amplitude and the pressure using a method selected from: a random adjustment; an adjustment calculated by applying settings from a pre-defined grid; an adjustment calculated by applying a heuristic search; an adjustment calculated from a look-up table comprising correlations between desired activity level changes and at least one of frequency, amplitude, and pressure; and an adjustment calculated by identifying correlations between changes in the stored time samples and changes in the stored at least one of frequency, amplitude, and pressure.

In one embodiment, the method further comprises the step of terminating stimulation when a maximum stimulation time is reached.

In one embodiment, the method further comprises the step of obtaining an input signal reflecting a measure of hypothalamic activity by functional neuroimaging. Examples of measures of hypothalamic activity obtainable by functional neuroimaging are defined in connection with the device and system aspects of the present invention. Examples of measures of hypothalamic activity obtainable by other methods than functional neuroimaging are different bodily responses, as defined in connection with the device and system aspects.

In one embodiment, the method further comprises the step of selecting a treatment area in the posterior part of the nasal cavity and imparting vibrations to the selected treatment area.

In one embodiment, the vibratory stimulation comprises a) providing a device comprising a stimulation member arranged for vibratory stimulation of the posterior part of the nasal cavity; b) introducing the stimulation member, preferably in an essentially non-expanded state, into the posterior part of the nasal cavity of the human subject; c) expanding the stimulation member such as to exert a pressure on the surrounding tissue in the posterior part of the nasal cavity, and d) bringing the stimulation member to vibrate in the posterior part of the nasal cavity. Examples of a vibration device are devices as disclosed in the device aspects of the present invention. In one embodiment of the method, a system as described in the system aspects of the invention is used.

Embodiments of the device and system aspect of the present invention are consequently, where applicable, relevant to the method aspect.

The device provided in a) may comprise an expandable stimulation member and a tubular structure arranged at least partly within the stimulation member, wherein the tubular structure is provided with a plurality of openings arranged for fluid communication with the stimulation member.

The method may moreover comprise bringing the stimulation member to an essentially non-expanded state; removing the stimulation member from the nasal cavity; and repeating the steps b)-d) as defined above in a second nasal cavity of the human subject.

Further objects and features of the present invention will be apparent from the detailed description and the claims.

BRIEF DESCRIPTION OF THE DRAWINGS

Referring now to the Figures, which are exemplary embodiments, and wherein the like elements are numbered alike.

DETAILED DESCRIPTION OF THE PREFERRED EMBODIMENTS

Embodiments of the present invention will now be described as non-limiting examples and with reference to the Figures.

Figure 1B:
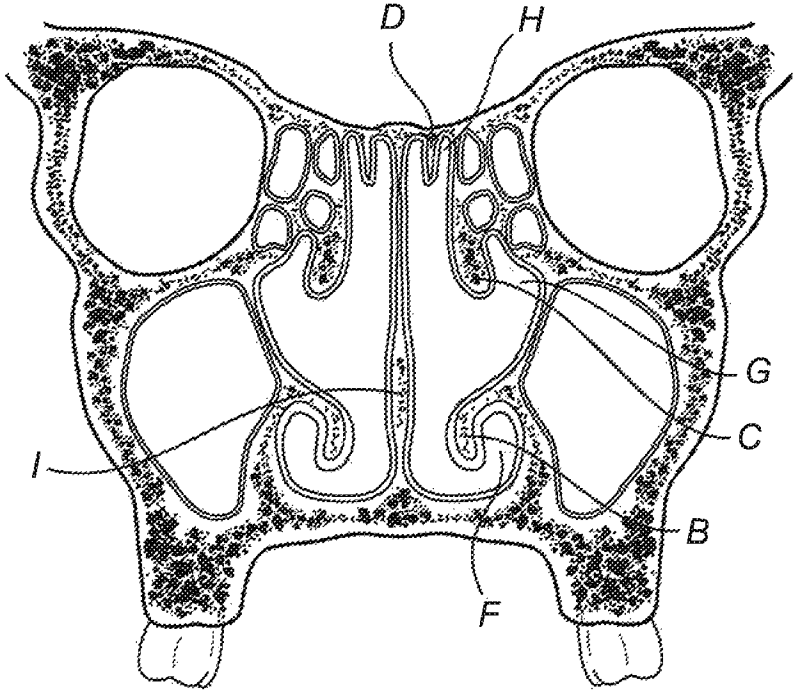
FIGS. 1A and B are schematic representations depicting a side view (A) and a front view (B) of the human nasal cavity(s)
Figure 1A:
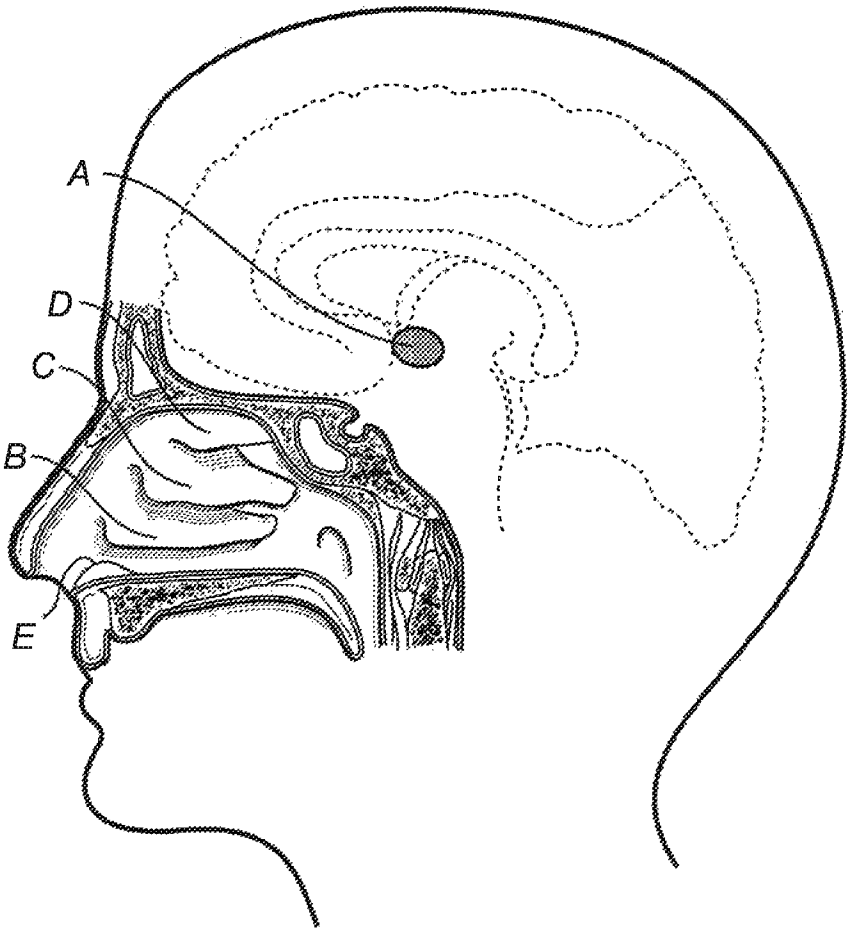

FIGS. 1A and B schematically depict the anatomy of the human nasal cavity(s). FIG. 1A is a side view schematically depicting a nasal cavity of a human and the position of hypothalamus, A, relative the nasal cavity. FIG. 1B schematically depicts the human nasal cavities seen from the front.

The nose has two cavities, separated from one another by a wall of cartilage called the septum, I, as can be seen in the front view of the nasal cavities in FIG. 1B. The vestibule, E, is the most anterior part of the nasal cavity. On the sides of the nasal cavity are three horizontal outgrowths called nasal conchae or turbinates. The conchae are several thin, scroll-shaped bony elements forming the upper chambers of the nasal cavities. They increase the surface area of these cavities, thus providing for rapid warming and humidification of air as it passes to the lungs. The inferior chonchae, B, are the largest of the choncha and are responsible for the majority of the airflow direction, humidification, heating and filtering of air inhaled through the nose. The open region defined by the inferior concha is called the inferior meatus, F. The middle chonchae, C, are smaller. They project downwards over the openings of the maxillary and ethmoid sinuses, and act as buffers to protect the sinuses from coming in direct contact with pressurized nasal airflow. Most inhaled airflow travels between the inferior chonchae and the middle chonchae. The open region defined by the middle conchae, C, is called the middle meatus, G. The superior chonchae, D, are smaller structures that serve to protect the olfactory bulb. The superior chonchae completely cover and protect the nerve axons piercing through the cribriform plate (a porous bone plate that separates the nose from the brain) into the nose. The open region defined by the superior conchae, D, is called the superior meatus, H.

Each inferior nasal concha, B, is considered a facial pair of bones since they arise from the maxillae bones and projects horizontally into the nasal cavity. Posterior of the inferior nasal conchae are the middle nasal conchae, C, and superior nasal conchae, D, which arise from the cranial portion of the skull. Hence, these two are considered as a part of the cranial bones.

The term anterior part of the nasal cavity as used herein should be understood as the part of the nasal cavity from the nostril to the anterior third of the inferior and middle conchae. The term posterior part of the nasal cavity as used herein should be understood as including at least the posterior two thirds of the inferior and middle conchae.

The communication path between the stimulation member of a device according to the present invention and the hypothalamus is not completely understood. However, a type of sensory receptors called mechanoreceptors is believed to be involved. Mechanoreceptors are responsible for detection and communication of mechanical influence. There are four main types of mechanoreceptors in the human body: Pacinian corpuscles, Meissner's corpuscles, Merkel's discs, and Ruffini corpuscles. Pacinian corpuscles (also known as lamellar corpuscles) detect rapid vibrations (200-300 Hz). Meissner's corpuscles (also known as tactile corpuscles) on the other hand detect changes in texture (vibrations around 50 Hz) and adapt rapidly. Merkel's discs (also known as Merkel nerve endings) detect sustained touch and pressure and adapt slowly. Ruffini corpuscles (also known as Ruffini's end organs, bulbous corpuscles, and Ruffini endings) are slowly adapting receptors that detect tension deep in the skin. Most studies of mechanoreceptors have been performed on the skin. Less is known about how the receptors react in the nasal mucosa or when they are attached to the cranial bones.

It is conceivable that the frequency content of the vibration stimulation according to the present invention may be fine tuned to match the response of some of the mechanoreceptors in order to obtain a desired therapeutic effect. There is a clear change in patient response when the frequency is varied, which can be interpreted as an excitation of a resonance within the body. Thus, by imparting vibrations within the posterior part of the nasal cavity, the nervous system may be excited at a particular frequency so as to transmit signals to the hypothalamus. Since the middle concha is attached to the cranial bone a large number of receptors with connections into the brain can be excited by the vibration stimuli.

Figure 2:
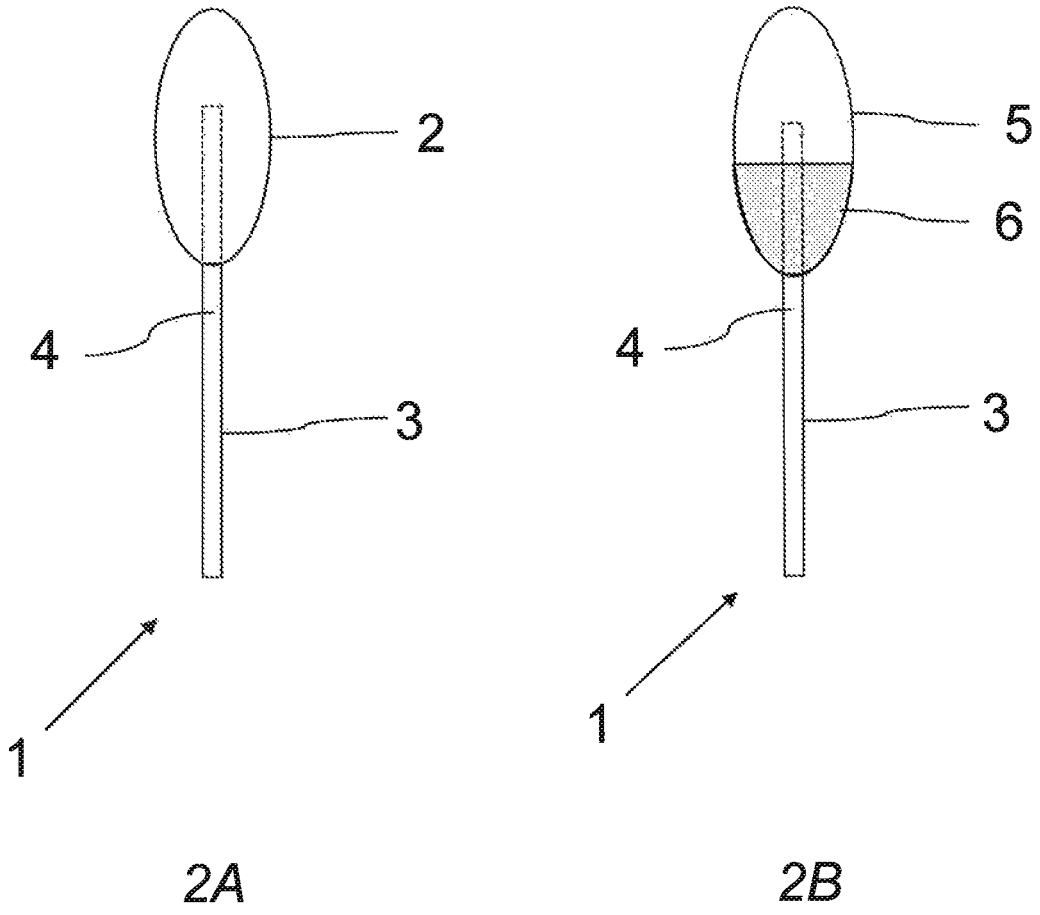
FIG. 2A-E are schematic representations each depicting an example of a device according to the device aspects of the present invention.

With reference to FIG. 2A, a specific example of a device according to the device aspects of the invention will now be discussed. The device 1 for stimulation of hypothalamus in a human subject comprises a stimulation member 2 arranged in an expanded, second state and an expansion member 3. The stimulation member 2 is arranged to partly surround the expansion member 3, such that the end portion of the expansion member is located inside the stimulation member. The end portion of the expansion member may be freely located inside the stimulation member. Freely located should in this context be understood as arranged without fixation to an inner wall of the stimulation member.

The expansion member may for example be freely located at a distance from an inner wall of the stimulation member. Experience has shown that when the device is inserted into the nasal cavity, patients sometimes experience pain, probably due to the comparatively stiff expansion member. When the stimulation member is expanded, the experienced pain sensation subdues. This is likely due to the fact that once expanded, the stimulation member gently push the tissue away from the end of the expansion member. The distance between the end of the expansion member and an inner wall of the stimulation member may be in the range of from 1 to 10 mm, or in the range 4 to 6 mm, or about 5 mm.

Alternative configurations are however also considered within the scope of the present invention. The stimulation member 2 may for example be connected adjacent to the end portion of the expansion member 3 not shown), and consequently arranged to not essentially enclose the expansion member. In yet another exemplary configuration, the stimulation member may be arranged as a sleeve around the expansion member 3 some distance away from the end portion (not shown).

The stimulation member may be made of a material such that it does not chemically or biologically affect any body tissue with which it comes into contact. Thus, it may have no local effect on body tissue. Non-limiting examples of materials are plastic materials or rubber materials. In some instances, the stimulation member is made of latex.

The stimulation member may furthermore comprise an outer surface that minimizes friction between the stimulation member and the surrounding tissue during introduction into and when positioned in the nasal cavity. The stimulation member may e.g. be constructed from a material providing a smooth outer surface or be coated with a lubricant, such as e.g. a paraffin solution. Further, the material of the stimulation member may be flexible, providing the stimulation member with elastic properties. The size and volume of the stimulation member may consequently vary by an inner pressure. In alternative embodiments, the stimulation member is made up of an inelastic material. In such embodiments, the size of the stimulation member is decreased in the first state of the device wherein the stimulation member is introducible into the nasal cavity. In the second state, the stimulation member is expanded for abutting against tissue surfaces. Furthermore, the stimulation member may have partly elastic properties, which makes it both shrink and fold when returning to the first state of the device. In such cases, the stimulation member may be made of a thin material which can fold.

One non-limiting example of a stimulation member is a balloon, which in an at least partly expanded state establishes a contact surface between the device and the posterior part of the nasal cavity. Other examples of a stimulation member include bags, bubbles and foam devices.

The expansion member 3, e.g. as depicted in FIG. 2A, comprises at least one channel 4 for supply of fluid to the stimulation member. The stimulation member thus comprises a chamber for containing fluid supplied by the expansion member. The chamber walls are defined by the inner surface of the stimulation member. The supply of fluid to the stimulation member via the expansion member thus influences the volume and degree of expansion of the stimulation member. To allow free passage of fluid from the expansion member to the stimulation member, the end portion of the expansion member comprises at least one opening. If the end portion of the expansion member 3 is arranged within the stimulation member 2, as for example depicted in FIG. 2A, the end portion may comprise more than one opening for supply of fluid to the stimulation member 2. One embodiment in which the end portion of the expansion member comprises more than one opening for supply of fluid to the stimulation member will be discussed in further detail below with reference to FIG. 2D. The parts of the expansion member 3 and stimulation member 2 in contact with the human body typically define a closed system to prevent leakage of fluid to the human body.

Examples of an expansion member comprising at least one channel include a pipe, a tubing, a conduit, a cylinder, a tube etc. The expansion member may for instance be made of a plastic, rubber or metal material.

The supply of fluid, e.g. a gas or a liquid, may be controlled by an external apparatus via the expansion member. Such an external apparatus may comprise a cylinder with a movable plunger that, by moving back and forth, can regulate the amount of fluid in the cylinder and thereby regulate the amount of fluid in the expansion member.

The expansion member preferably has dimensions such as allow an operator to position the stimulation member accurately.

In embodiments where the device comprises a vibration member arranged to bring the stimulation member to vibrate, the vibration member may for example comprise a vibration generator controlled by an applied electrical voltage supplied from a control unit. In such examples, the vibration member may be arranged within the stimulation member.

In another example, the vibration member is externally arranged. Such an external vibration source, for example a transducer, may be arranged so as to supply vibrations to a fluid contained within the stimulation member.

Vibrations may furthermore be imparted to the posterior part of the nasal cavity via the fluid comprised within the stimulation member. Thus, the vibration member may provide vibrations to the fluid, which functions as a medium for transferring vibrations via the expansion member to the stimulation member.

The vibratory stimulation in the posterior part of the nasal cavity may be conducted at a frequency of between 40-100 Hz, but other frequencies are also anticipated. The amplitude of the vibrations applied to the posterior part of the nasal cavity may be comprised within the range of between approximately 0.05 mm and approximately 20 mm, such as 0.3 mm and approximately 5 mm, but other amplitudes are also anticipated. It should be understood that the amplitude required for a certain level of stimulation in hypothalamus is governed by the nature of the nasal cavity and the sensitivity of the patient in question.

With reference to FIG. 2B, a specific example of a device according to the invention will now be discussed. The device 1 for stimulation of hypothalamus in a human subject comprises a stimulation member 2 and an expansion member 3. The stimulation member 2 comprises a stimulating portion 5, which in an expanded second state abuts and imparts vibrations to tissue of the posterior part of the nasal cavity. A retaining portion 6 of the stimulating member is arranged to abut tissue in the anterior part of the nasal cavity. In this example of a device according to the invention, the stimulating portion of the stimulating member may be arranged in a first non-expanded and a second at least partly expanded state, whereas the retaining portion remains in a non-expanded state. While the stimulating portion may consist of a flexible material, the retaining portion may consist of an inelastic, optionally enforced or rigid material. The stimulating portion 5 and the retaining portion 6 are in this case both arranged to at least partly surround the expansion member 3, such that an end portion of the expansion member is located inside the stimulation portion.

Figure 2C:
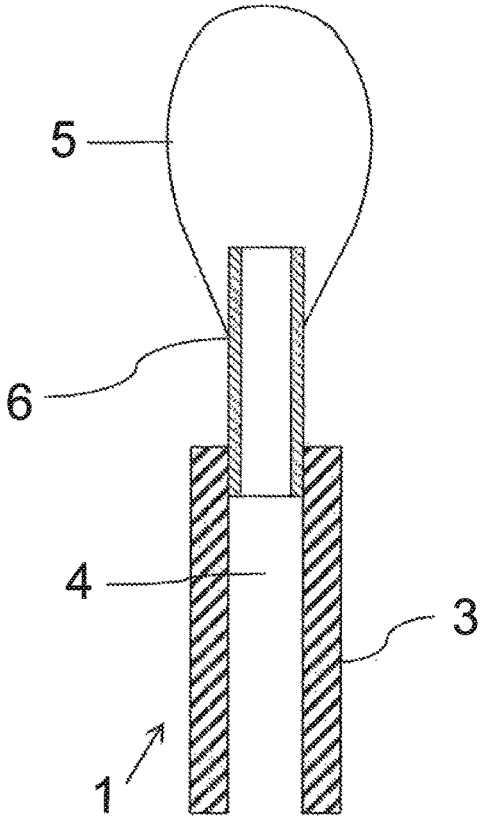

In FIG. 2C, an example of a device comprising a stimulating portion and a retaining portion is depicted. The device 1 comprises a stimulation portion 5 and a retaining portion 6 of the stimulating member 2. The retaining portion 6 extends within the stimulating portion 5. Both the retaining portion and the end portion comprises a channel 4 to allow free passage of fluid into and from the stimulating portion 5. The retaining portion 6 is partly arranged within the channel 4 of the expansion member. The dimensions of the retaining portion are thus adapted to fit within the expansion member 3 and within the stimulating portion 5.

Figure 2D:
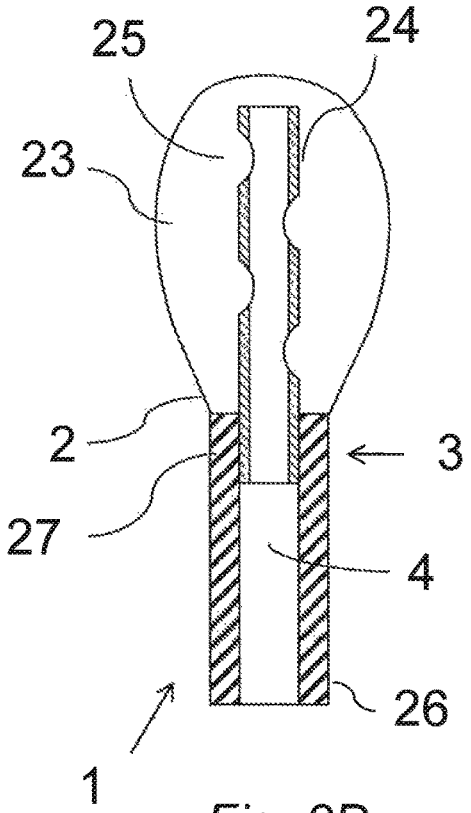

In FIG. 2D, an example of a device for stimulating hypothalamic activity by imparting vibrations to the posterior part of the nasal cavity is shown. The device 1 comprises an expandable stimulation member 2 depicted in an at least partly expanded state. The interior 23 of the stimulation member 2 is fluidly connected with an expansion member 3 arranged to expand the stimulation member. The expansion member 3 comprises a tubular structure 24, which may be arranged at least partly within the stimulation member. The tubular structure 24 is provided with a plurality of openings 25 arranged for fluid communication with the interior 23 of the stimulation member 2. The expansion member 3 moreover comprises an elongated structure 26 arranged in fluid communication with the interior 23 of the stimulation member via the tubular structure 24. The elongated structure may be arranged essentially outside the stimulation member 2, or partly inside the stimulation member 2. The elongated structure may enclose a part of the tubular structure 24. Each end portion of the tubular structure 24 may be provided with an opening for fluid communication with the interior 23 of the stimulation member and the elongated structure 26. Fluid communication may be accomplished through channel 4. The tubular structure 24 may extend within essentially the entire length of the stimulation member 2. In one embodiment, the tubular structure leaves a distance from an end of the tubular structure to an inner wall of the stimulation member of 5 mm. The end portion of the tubular structure 24 is however distanced from the inner walls of the stimulation member.

An end portion 27 of the elongated structure arranged adjacent to the stimulation member, or arranged within the stimulation member, may function as a retaining portion when the device is inserted into the nasal cavity of a human subject. Such an end portion 27 of the elongated structure 26 may be inserted into the nostril of the human subject.

The tubular structure is sufficiently resilient to allow for insertion and positioning in, sometimes irregular, shape of the nasal cavity. This is particularly important for movements in the sagittal plane since the stimulation member must pass in a vertical bend through the vestibule. At the same time, the tubular structure must provide sufficient stiffness in order to avoid accidental bending during introduction into the posterior part of the nasal cavity. The tubular structure has a sufficient inner diameter in order to avoid flow resistance, which might cause damping out of vibrations before reaching the stimulation member. Furthermore, the tubular structure may have a wall thickness that in combination with the plurality of openings achieves a suitable stiffness. Other material and mechanical properties may also have an influence on the stiffness of the tubular structure.

An end portion of the tubular structure arranged within the stimulation member may be rounded or beveled to prevent the device from getting stuck when introduced into the nasal cavity and to minimize any discomfort for the patient.

The tubular structure comprising the plurality of openings may enable expansion of the stimulation member along its entire length. Since the walls of the nasal cavity varies between individuals and sometimes result in narrow passages, the plurality of openings allows fluid to enter and expand the stimulation member along its entire length. In the embodiment shown in FIG. 2D the openings have been placed alternating on the two sides of the tubular structure to ensure that the anisotropic stiffness is sufficient.

Figure 2E:
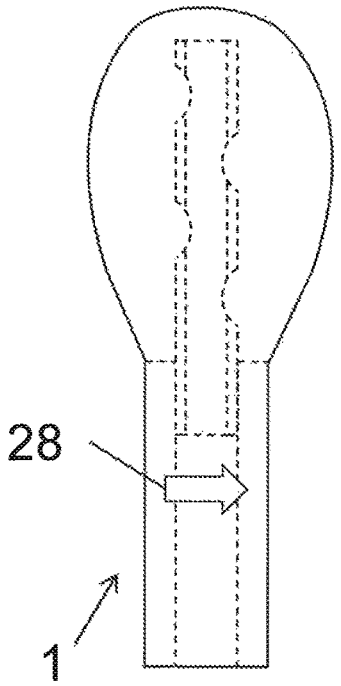

In an embodiment wherein the openings are provided on alternating side portions of the tubular structure, it may be advantageous to provide a visial marking 28 on the device 1 as depicted in FIG. 2E to facilitate and ensure insertion in the correct angular orientation.

Figure 3B:
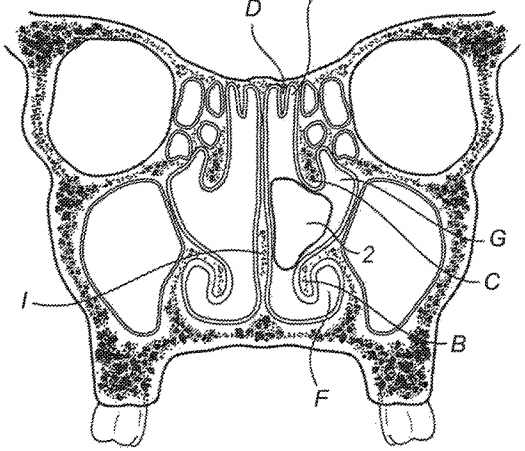
FIGS. 3A and B are schematic representations depicting one example of a device according to the device aspects of the present invention positioned within the nasal cavity of a human subject, seen from the side (A) and from the front (B)
Figure 3A:
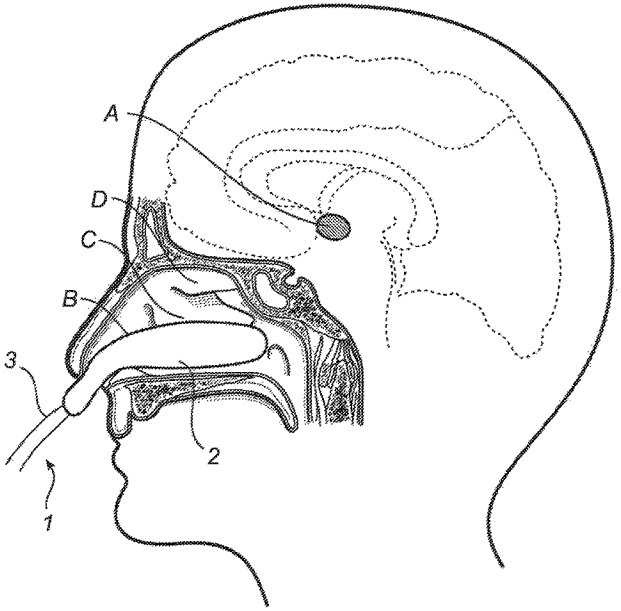

In FIG. 3A, the stimulation member 2 of the device 1 is in an at least partly expanded state positioned within the nasal cavity. An expansion member 3 is partly located within the stimulation member 2 and partly located outside of the nasal cavity during vibration stimulation. The expansion member 3 accordingly provides expansion of the stimulation member 2 to a size and/or volume which is suitable for stimulation. Such expansion may be achieved by supply of fluid to the stimulation member through one or more channels, which are comprised in the expansion member. The volume of fluid supplied to the stimulation member in turn influences the inner pressure of the stimulation member and consequently the pressure exerted on the surrounding tissue. The stimulation of hypothalamus by imparting vibrations to the posterior part of the nasal cavity is initiated when the stimulation member has obtained satisfactory contact with the tissue of the nasal cavity.

The stimulation member may, when it abuts nasal tissue in its expanded state, for instance have a circular, oval or droplet shape, depending on the nasal anatomy of the patient in question.

The dimensions of the stimulation member or, where applicable, the stimulating portion, may evidently be adapted to the size and shape of the nasal cavity of the patient to be treated. The length of the stimulation member when located within the nasal cavity may vary between approximately 3 mm to approximately 100 mm, for example from 40 to approximately 60 mm, for a Caucasian adult. When the patient on the other hand is a newborn baby, the length of the stimulation member when located within the nasal cavity may be from approximately 3 mm to approximately 20 mm. It should be understood that the actual length of the stimulation member when positioned within the nasal cavity is dependent on the degree of expansion of the stimulation member and the size of the nasal cavity. A stimulating portion of a stimulating member may e.g. have a length of 25 mm when positioned within the posterior part of the nasal cavity.

The lateral width of the stimulation member or, where applicable, the stimulating portion, when positioned in the nasal cavity may for instance vary from approximately 1 mm to approximately 40 mm, such as from approximately 10 to approximately 20 mm for an adult, depending on the degree of expansion of the stimulation member or the stimulating portion and the size of the nasal cavity. When positioned in the nasal cavity of a newborn, the stimulation member or stimulating portion may be approximately from 1 to approximately 3 mm wide. It is understood that, depending on the patient to be treated, the dimensions of the stimulation member or stimulating portion may vary outside of the ranges given above.

In certain aspects of the present invention, a plurality of geometrically different stimulation members is provided. Such a plurality may for instance be provided in a kit of different stimulation members, wherein each of the stimulation members differs from the others in e.g. length and lateral width. A plurality of stimulation members may be defined as comprising two, three, four, five, or more stimulation members having different dimensions and shape, for example within the ranges as disclosed above. The stimulation members may exhibit different laterally curved and bent forms to facilitate insertion and positioning.

To render possible a smooth and painless introduction into the nasal cavity, the width of the stimulation member or the stimulating portion may, when arranged in the first state, not exceed the width of the nostril of the patient to be treated. In newborns, for instance, the stimulation member or the stimulating portion may, in its first state, be approximately 1 mm wide. To further facilitate the introduction of the stimulation member into the nasal cavity it may be preformed with a slight bend to better fit the nasal anatomy.

The device according to the present invention may conveniently comprise a safety valve, which, in case the pressure within the stimulation member exceeds a certain maximum value, can release some of the pressure, for example by releasing fluid from the stimulation member.

To further facilitate insertion and positioning within the nasal cavity, the device may be provided with a scale to aid the person performing the stimulation. The expansion member may for example be provided with such a scale, which, together with any prior knowledge of the particular patient's anatomy may indicate how far into the nasal cavity the device has been inserted. Alternatively, the device may be provided with a stop bigger than the nostril to prevent the stimulation member from being inserted too far into the nasal cavity. An example of the latter is shown in FIG. 2C, wherein the outer diameter of the expansion member 3 can be made larger that the nostril.

In other embodiments, the device is provided with anchoring means to prevent the device from unintentionally moving during the stimulation in the nasal cavity. Anchoring means may be provided in the form of a helmet, facial mask or a headband. Such anchoring means keep the stimulation member in constant position relative to the nasal cavity even if the patient moves his/her head during the stimulation or if some other disturbance occurs.

In embodiments where the stimulation member comprises a stimulating portion arranged to abut against the tissue of the posterior part of the nasal cavity and a retaining portion arranged to abut against the tissue of the anterior part of the nasal cavity, wherein the stimulating portion is arranged to stimulate hypothalamus, the retaining portion may function as anchoring means.

Figure 4:
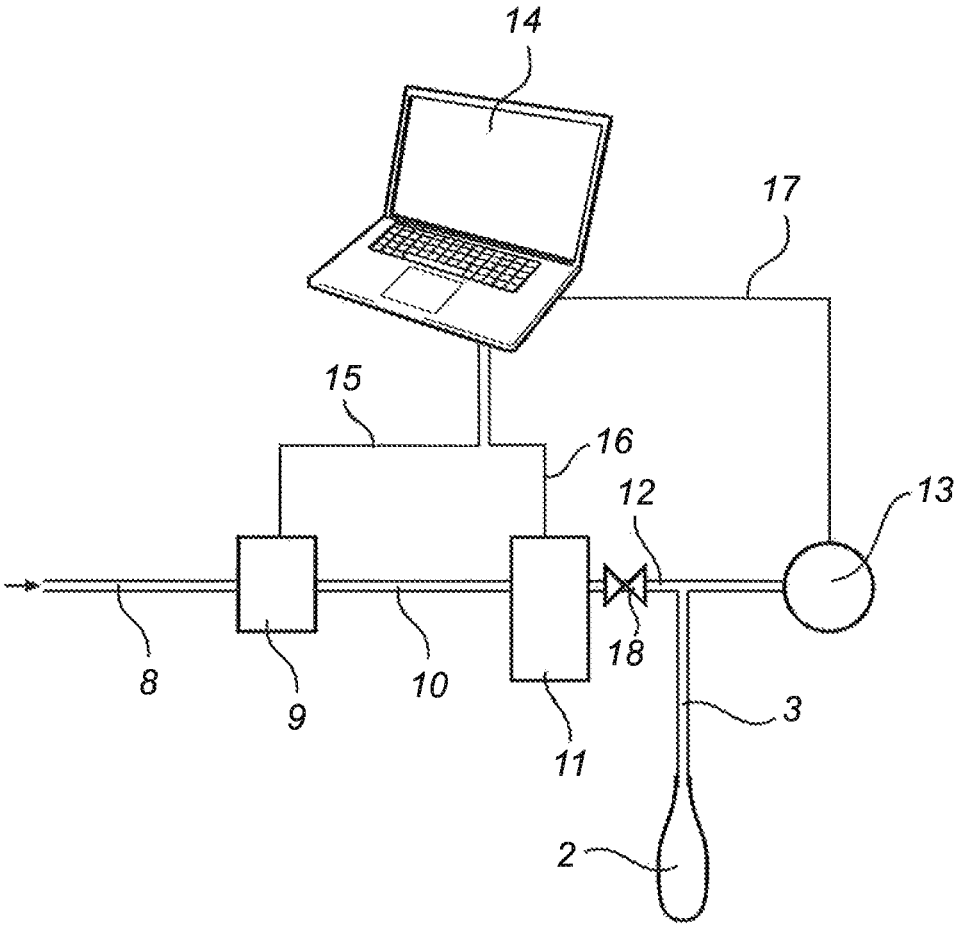
FIG. 4 is a schematic view depicting an example of a system according to the system aspect of the present invention.
Figure 5:
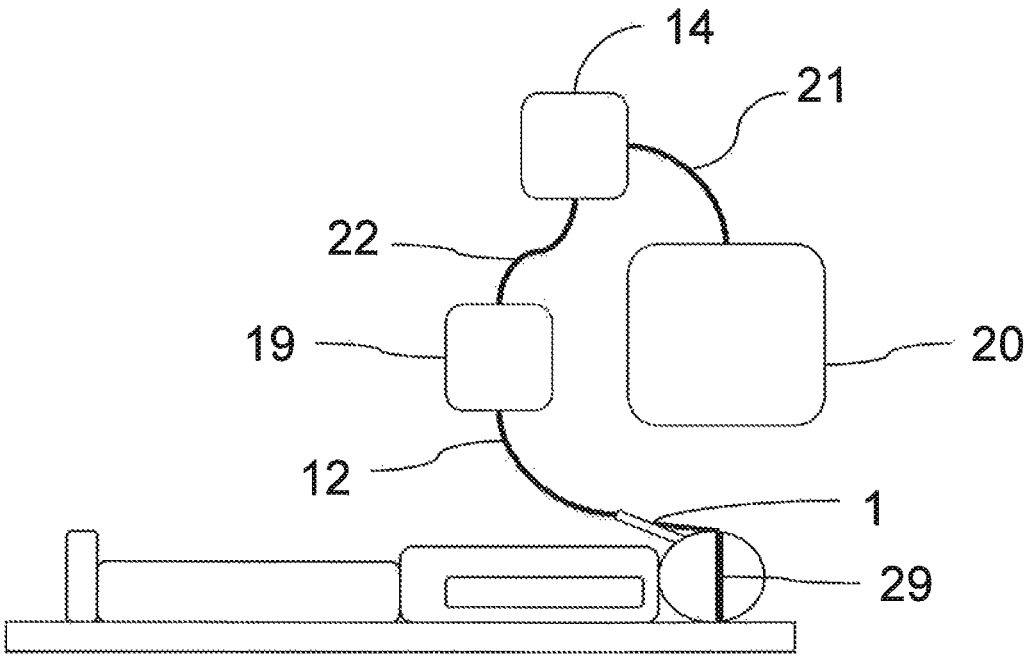
FIG. 5 is a schematic view depicting an example of use of a system according to the system aspect of the present invention.

With reference to FIGS. 4 and 5, specific examples of a system according to the system aspect of the invention will now be discussed.

The system of FIG. 4 comprises device 1, having a stimulation member 2 and expansion member 3, as described above. Fluid such as air enters the system via inlet 8. In the pressure regulating module 9, e.g. a pressure pump, the fluid is pressurized before being supplied to a frequency and amplitude regulating module 11 via tubing 10. The frequency and amplitude regulating module, e.g. an oscillation pump, provides vibrations having a desired frequency and amplitude to the pressurized fluid which, via tubing 12 and expansion member 3, is supplied to the device 1. The system pressure is monitored by a pressure sensor 13, such as a manometer. Alternatively, the pressure sensor could be integrated in the pressure regulating module or the frequency and amplitude regulating module.

The control unit 14 receives input via line 15 from the pressure regulating module 9, via line 16 from the frequency and amplitude regulating module 11 and via line 17 from the pressure sensor 9. The control unit further controls the pressure regulating module 9 via line 15 and the frequency and amplitude regulating module 11 via line 16. Embodiments where the control unit 14 does not receive input from any one of or all of the regulating modules and sensor, but only outputs instructions to the regulating modules, are also within the scope of the present invention.

The system is further provided with safety valve 18, arranged to release fluid from the system should the system pressure get too high.

The control unit 14 may moreover comprise a data collection module arranged to collect input from the above mentioned regulating modules and sensor. The data collection module may moreover obtain an input signal reflecting a measure of hypothalamic activity. Thus, control unit 14 may receive an input signal from a monitoring device (20, FIG. 5), such as a functional neuroimaging device. One example of a control unit is a microprocessor comprising suitable peripheral I/O capability executing software e.g. for analyzing the input signal and to determine how to adjust e.g. any of the frequency, the amplitude and the pressure. It is contemplated that other types of control units may be used, such as e.g. a personal computer.

An analyzing module (not shown) may moreover be comprised within the control unit. Such an analyzing module provides analysis of the data collected from the separate parts of the system, where applicable from the devices, modules and/or sensor of the system. The analyzing module may for example compare a previously collected value of the input signal with a later collected value of the input signal, and subsequently compare the difference between the two with a threshold tolerance.

In other examples of a system, a data processing module (not shown) is comprised within the control unit. The data processing module provides calculations of the collected input signal and of e.g. thresholds. Based on analysis of processed data, such as the derivative of the input signal reflecting a measure of hypothalamic activity, the analyzing module is arranged to instruct any one of the regulating modules that may be present in the system to adjust e.g. the frequency, the amplitude and/or the pressure. The derivative of the measure reflects the rate of change of the measure and may thus indicate for example when adjustment of the above mentioned parameters should be made in order to achieve a change in the measure, and in addition when no more changes in the measure can be expected and stimulation consequently should be terminated.

Thus, when a first threshold of the hypothalamic measure is reached, e.g. as represented by the derivative being close to zero, the analyzing module may be arranged to instruct the frequency regulating module, the amplitude regulating module and the pressure regulating module to adjust the frequency and/or the amplitude to zero and the pressure to reflect atmospheric pressure.

A second threshold may moreover be determined. This second threshold may be expressed as a function of both the measured value and its rate of change. For example, if the rate of change is sufficiently small and the measured value is considered as high the analyzing module proposes continued treatment in a second nasal cavity. One example of a second threshold is $tol_2$ in FIGS. 7A and D.

The analyzing module may moreover be arranged to terminate stimulation dependent on stimulation time. A maximum stimulation time can be defined after which the stimulation is terminated irrespective of which activity level has been attained (see e.g. $t_{max}$ in FIG. 7). A minimum stimulation time can defined as the shortest time interval during which vibrations are administered (e.g. $t_{min1}$ in FIG. 7). Having a minimum stimulation time may be advantageous, since any unstable readings in the beginning of a stimulation period may be disregarded. In the case where vibration stimulation in both nasal cavities is desired, the minimum stimulation time corresponds to the stimulation time in a first nasal cavity before switching nasal cavity (e.g. $t_{min2}$ in FIG. 7) or the minimum stimulation time for each nasal cavity.

In another example, the system further comprises a memory module (not shown, may e.g. be integrated within the control unit) arranged to store at least one previously obtained value of the input signal. The memory module is arranged to either store several previous individual values of the input signal, such as a history of previously obtained individual values of the input signal, or to successively replace a previous value of the input signal each time the data collection module obtains a new signal, but after the above defined analysis has been made.

FIG. 5 demonstrates vibration stimulation in the nasal cavity of a human patient with an exemplary system according to the invention. A device 1 is positioned within the nasal cavity of the patient. The stimulation member is expanded to a second state such that it abuts the posterior part of the nasal cavity. A regulating module 19 for regulation of one or more of pressure, vibration frequency and amplitude is connected to the device 1 via tubing 12. When imparting vibrations to the posterior part of the nasal cavity, hypothalamic activity is monitored by monitoring device 20. The monitoring device 20 may provide real-time monitoring of a direct or indirect measure correlated to hypothalamic activity, such as for example hypothalamic blood flow, oxygen consumption and metabolic activity. One example of a monitoring device is an fMRI instrument.

Control unit 14 receives an input signal reflecting a hypothalamic measure via line 21 from the monitoring device. The control unit 14 comprises a data collection module (not shown) for obtaining the signal. An analyzing module (not shown) and a data processing module (not shown) may moreover be provided within the control unit. The control unit 14 receives information on vibration parameters from the regulating module via line 22. The control unit may via the same line 22 output instructions for controlling the regulating module 19. Such instructions are based on analysis of the input signal obtained from the monitoring device and aims at adjusting any one of the parameters of pressure, vibration frequency or amplitude. In certain instances, when the input signal reflecting a measure of hypothalamic activity reaches a threshold, the control unit may instruct the regulating module to terminate the stimulation and optionally continue the stimulation in a second nasal cavity.

Figure 6:
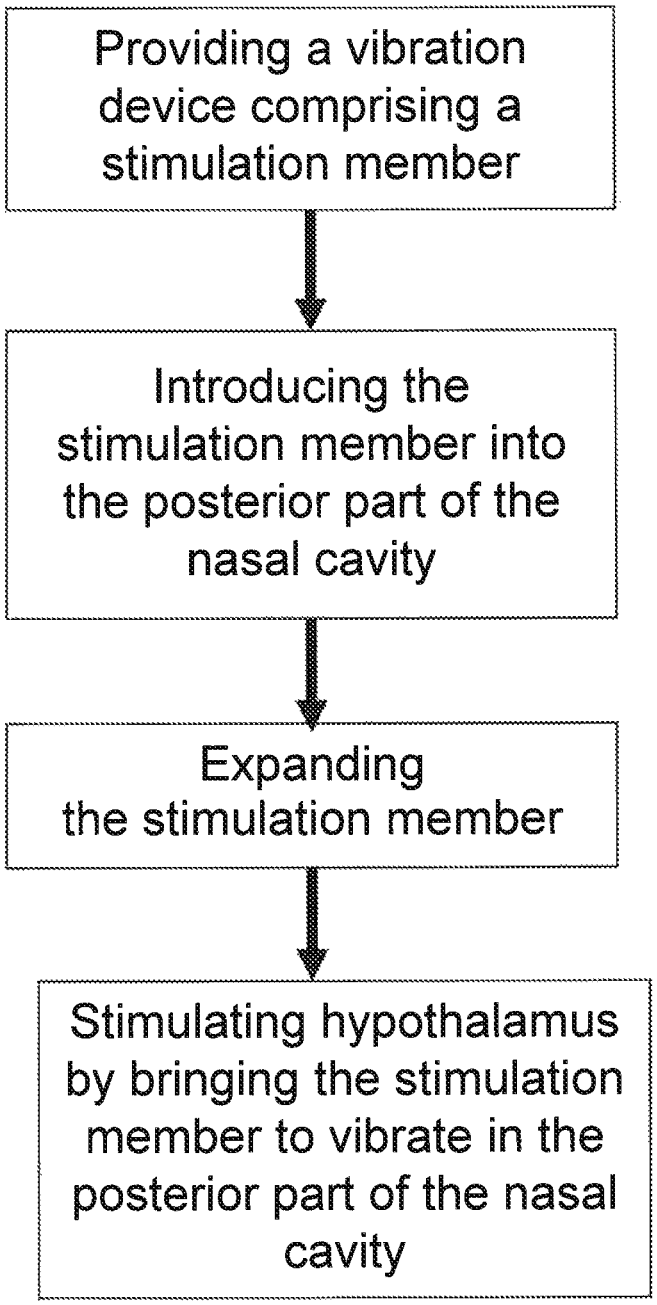
FIG. 6 is a flow chart indicating the steps comprised in one embodiment of a method for stimulation of hypothalamus according to the present invention.

A method for stimulating hypothalamus by treatment in the posterior part of the nasal cavity is exemplified below with reference to FIG. 6.

A device comprising a stimulation member is provided. The stimulation member is via the nostril introduced into the posterior part of the nasal cavity of a patient. The device is thus in a first, essentially non-expanded state when introduced in order to facilitate passage through the nostril and to minimize the risk of frightening the patient by presenting a bulky instrument. When positioned adequately within the posterior part of the nasal cavity, the stimulation member is expanded to a second state such that the stimulation member is brought into close contact with the tissue of the posterior part of the nasal cavity as exemplified in FIG. 3. It is to be understood that the volume of the stimulation member may be adjusted to the size of the nasal cavity such that a good contact is achieved with the body tissue prior to vibration stimulation. A good and/or close contact refers to such a contact that the available outer surface of the stimulation member in a second, at least partly expanded, state essentially abuts against the surface of the tissue.

Subsequently, the stimulation member is brought to vibrate to stimulate hypothalamus. In some instances, where applicable, the stimulation member abuts the surface of the tissue at a relatively high pressure when initiating the stimulation. After an initial phase of stimulation, the pressure exerted on the surface of the tissue may be lowered. This relatively lower pressure may be used for the remaining stimulation period, provided that the measure of hypothalamic activity changes in the desired way.

When the desired effect on hypothalamic activity is achieved, the stimulation is suitably terminated. The at least partly expanded stimulation member is suitably returned to an essentially non-expanded first state before it is removed through the nostril. Contraction of the stimulation member may for instance be achieved by reduction of fluid pressure within the stimulation member by removal of fluid through the expansion member. When the stimulation member is adequately contracted to an at least partly non-expanded state, the stimulation member may be removed from the nose by the patient himself/herself or by assisting personnel.

It is contemplated that hypothalamic stimulation may be performed with at least one stimulation member in at least a first nasal cavity of the human subject. For example, one device according to the first aspect may be used for single stimulation in one nasal cavity only or for sequential stimulation in both nasal cavities. In another example, two devices according to the first aspect may be used for simultaneous vibratory stimulation in both nasal cavities. It should be understood that pressure and vibration frequency may be the same or different for sequential and/or simultaneous stimulation in both nasal cavities. Two different vibration frequencies with a phase and/or amplitude difference may be applied during simultaneous stimulation to achieve an interference effect.

Prior to stimulation, the method may involve selecting from a plurality of devices comprising stimulation members having individually different geometry a device comprising a stimulation member having a geometry suitable for the posterior part of the nasal cavity of the human subject to be treated. As previously discussed, certain patients might require a stimulation member having a certain shape, length and width/diameter.

In addition, a treatment duration suitable for the patient in question may be selected prior to initiating the stimulation in the nasal cavity. Such selection may comprise selecting a minimum duration for standard stimulation, such as at least 5 minutes in total. Alternatively, the treatment duration may be defined as the period of treatment after the measure of hypothalamic activity has fulfilled a predetermined requirement. Such as after the first threshold is reached, stimulation may continue for yet another 2-5 minutes. Other treatment regimens involve selecting a duration of treatment in a first and/or second nasal cavity.

When the method of hypothalamic stimulation as disclosed herein involves treatment of a disease associated with hypothalamic dysfunction, it should be understood that such treatment may suitably be performed preventive or acute.

With reference to FIG. 7A-D, specific examples of stimulation procedures according to the system and method aspects of the present invention will be discussed. FIG. 7A-D represent examples of how stimulation may be conducted and controlled.

Figure 7A:
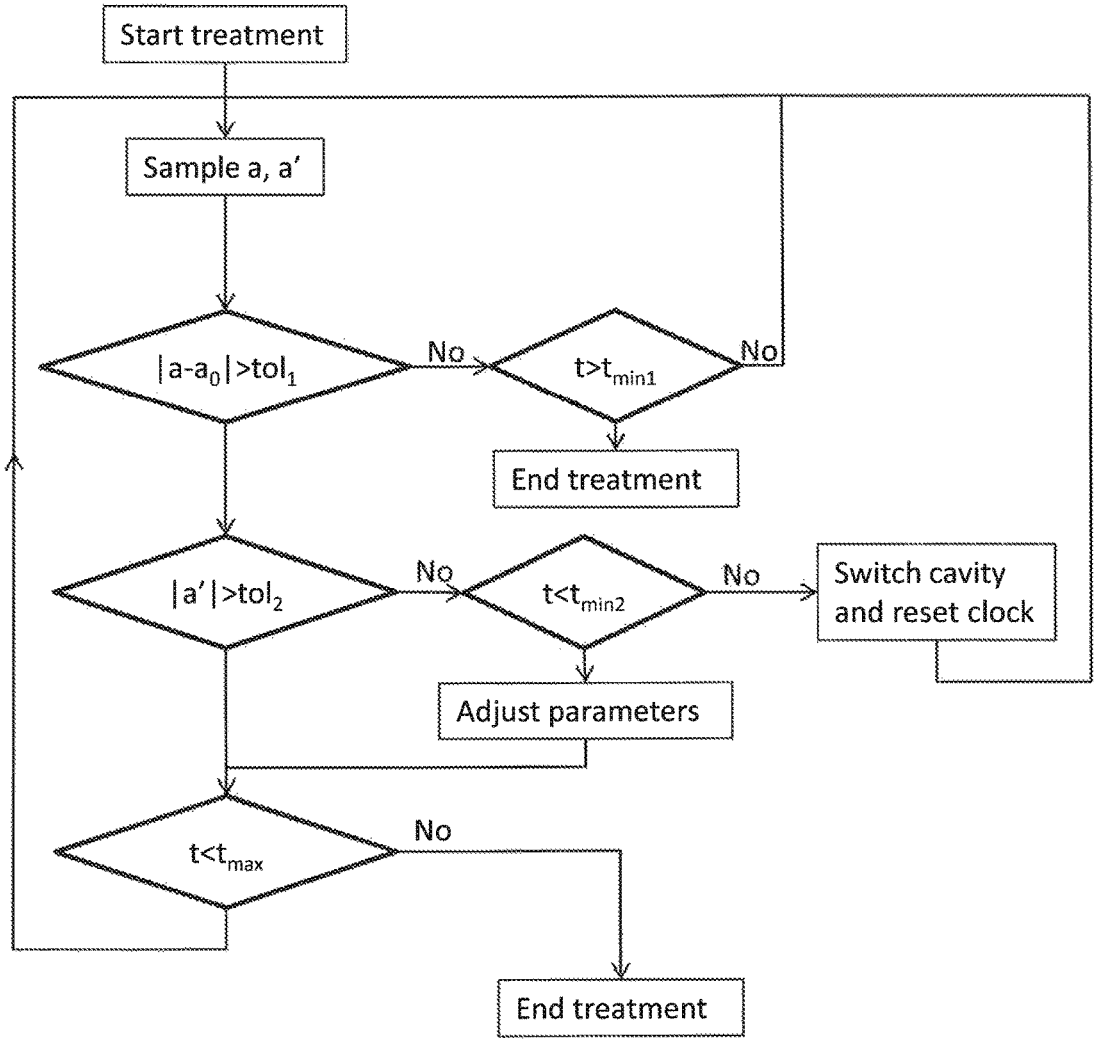
FIG. 7A-D are flow charts showing examples of treatment procedures according to the system and method aspects of the present invention.

With reference to FIG. 7A, an input signal reflecting a measure of hypothalamic activity (a) is collected after initiating the stimulation. When the absolute value of the difference between the activity measure (a) and a desired activity ($a_0$), i.e. $|a-a_0|$, is large and thus exceeds a first threshold ($tol_1$), the absolute value of a calculated time derivative (a') of the activity measure (a) is compared to a second threshold ($tol_2$). Should the absolute value of a calculated time derivative (a') exceed the second threshold ($tol_2$) stimulation may be continued and the next cycle is initiated by collection of a new activity measure, provided that a maximum stimulation time has not been reached. When the maximum stimulation time ($t_{max}$) is reached, stimulation is terminated regardless of the current activity measure.

When the absolute value of the difference between the activity measure (a) and a desired activity ($a_0$) does not exceed a first threshold ($tol_1$), the hypothalamic activity has practically reached the desired level. Provided that the stimulation time exceeds the minimum stimulation time ($t_{min1}$), stimulation may be terminated. If not, stimulation is continued with the same parameter set until the minimum stimulation time is reached.

When the absolute value of a calculated time derivative (a') does no longer exceed the second threshold ($tol_2$), i.e. when the measure is not changing that much, stimulation may be continued but the parameter set adjusted. Adjustment of parameters such as frequency, amplitude and pressure is done provided that the stimulation time does not exceed a second minimum stimulation time ($t_{min2}$). If the second minimum stimulation time ($t_{min2}$) has been reached, the stimulation should be continued in the second nasal cavity and the clock should be reset.

Figure 7B:
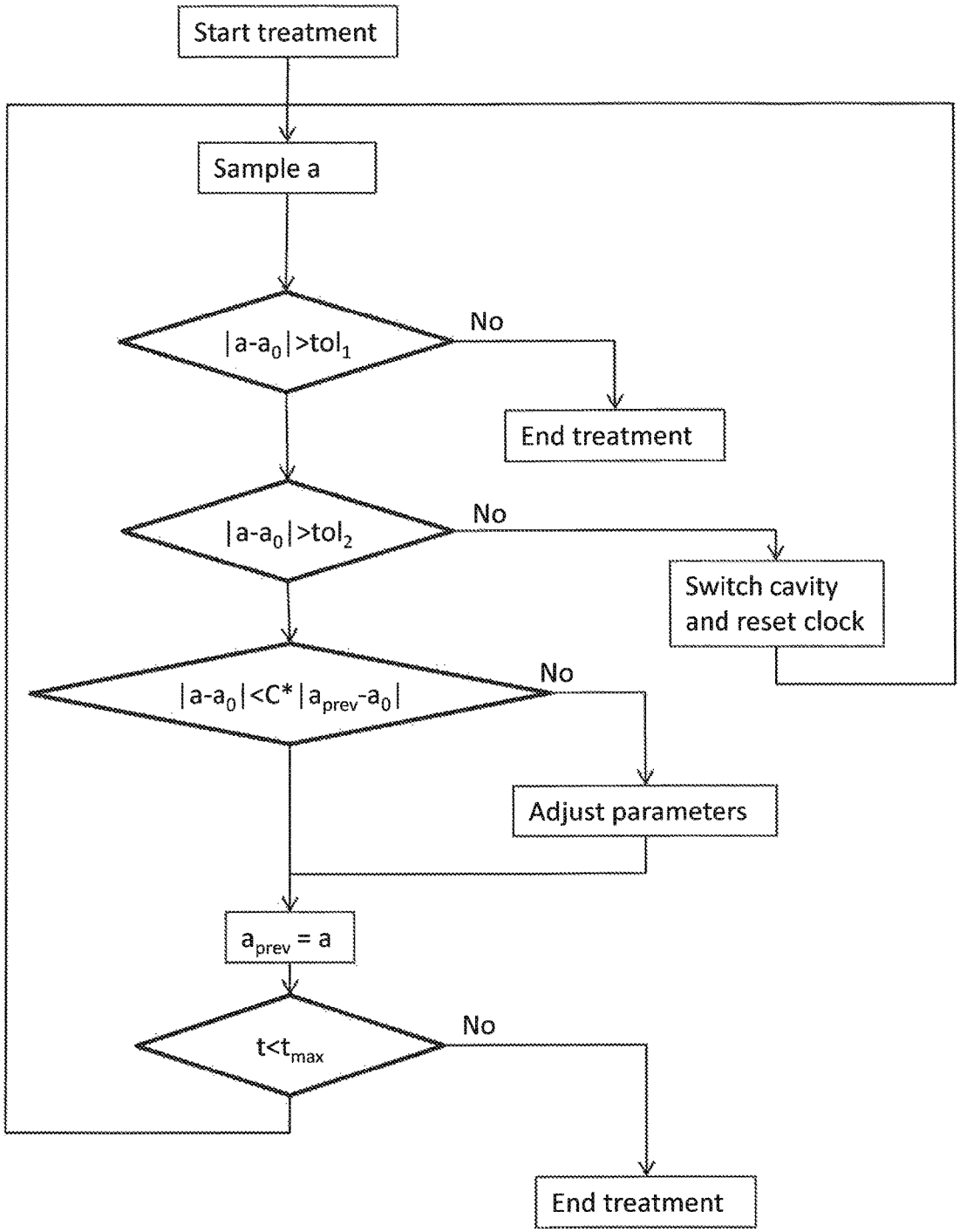

FIG. 7B represents another example of how hypothalamic stimulation can be systematically performed. In similarity to FIG. 7A, an input signal reflecting a measure of hypothalamic activity (a) is collected after initiating the stimulation. When the absolute value of the difference between the activity measure (a) and a desired activity ($a_0$) is large and thus exceeds a first threshold ($tol_1$), the same absolute value of the difference between the activity measure (a) and a desired activity ($a_0$) is compared to a second threshold ($tol_2$). If the absolute value $|a-a_0|$ also exceed the second threshold ($tol_2$), a third comparison is made. The same absolute value is compared to the absolute value of the difference between a previous activity ($a_{prev}$) measure and the desired level of activity ($a_0$) multiplied by a constant (C), ($C*|a_{prev}-a_0|$). If the absolute value $|a-a_0|$ is less than $C*|a_{prev}-a_0|$, then the activity measure is changing in the desired direction. This means that the current activity measure is closer than the previous measure to the desired activity. Provided that the maximum stimulation time ($t_{max}$) has not been reached, the cycle is iterated once again. Before start of the next cycle, the current activity measure is stored as $a_{prev}$. If the $t_{max}$ on the other hand has been reached, the stimulation is terminated.

Should the activity measure (a) on the other hand be close to or the same as the desired activity ($a_0$), i.e. when $|a-a_0|$ is less than the first threshold, the stimulation is terminated. Similarly, should $|a-a_0|$ be less than the second threshold, the stimulation is terminated in the first nasal cavity and continued in a second nasal cavity. A new cycle may thus be initiated according to the same scheme and the clock is reset.

Should the absolute value of the difference between the activity measure and the desired activity on the other hand be larger than the corresponding difference with a previous activity measure, i.e. $C*|a_{prev}-a_0|$, the hypothalamic activity has not changed as desired. The constant C constitutes one example of a threshold tolerance as defined herein. The parameter set is thus adjusted before start of the next cycle, the current activity measure is stored as $a_{prev}$ and the stimulation time is compared to $t_{max}$.

Figure 7C:
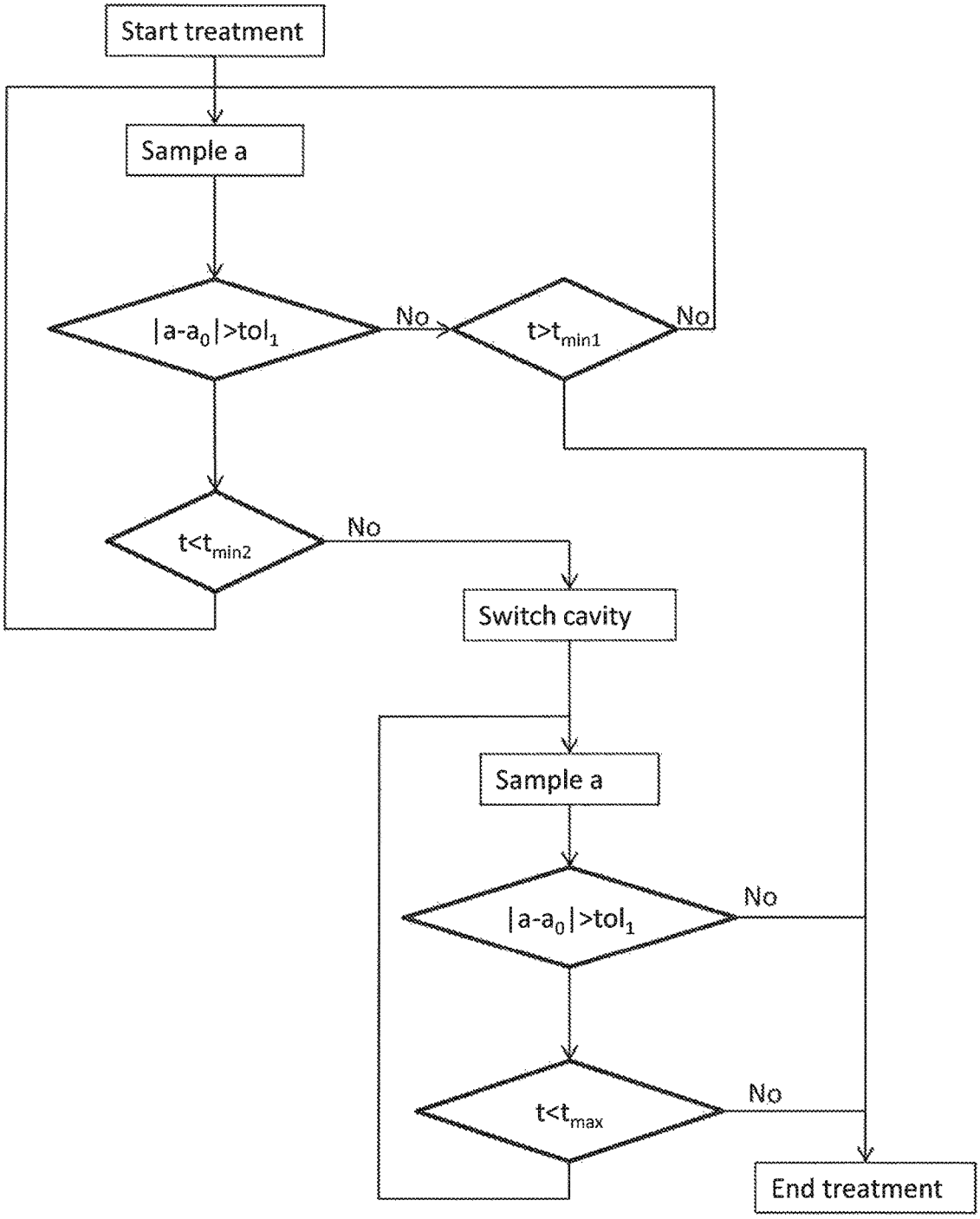

A further example of a stimulation procedure is depicted in FIG. 7C. In similarity to FIGS. 7A and B, an input signal reflecting a measure of hypothalamic activity (a) is collected after initiating the stimulation. The absolute value of the difference between the activity measure (a) and a desired activity ($a_0$) is compared to a first threshold ($tol_1$), and if it does not exceed $tol_1$, stimulation is terminated provided that the first minimum stimulation time ($t_{min1}$) has been reached. If it does exceed $tol_1$ and the second minimum stimulation time ($t_{min2}$) has not been reached a new cycle is initiated. If however the second minimum stimulation time has been reached stimulation in the first nasal cavity is terminated and stimulation is continued in the second nasal cavity. This is done without resetting the clock. Stimulation now continues either until the desired activity level or the maximum stimulation time ($t_{max}$) has been reached.

Figure 7D:
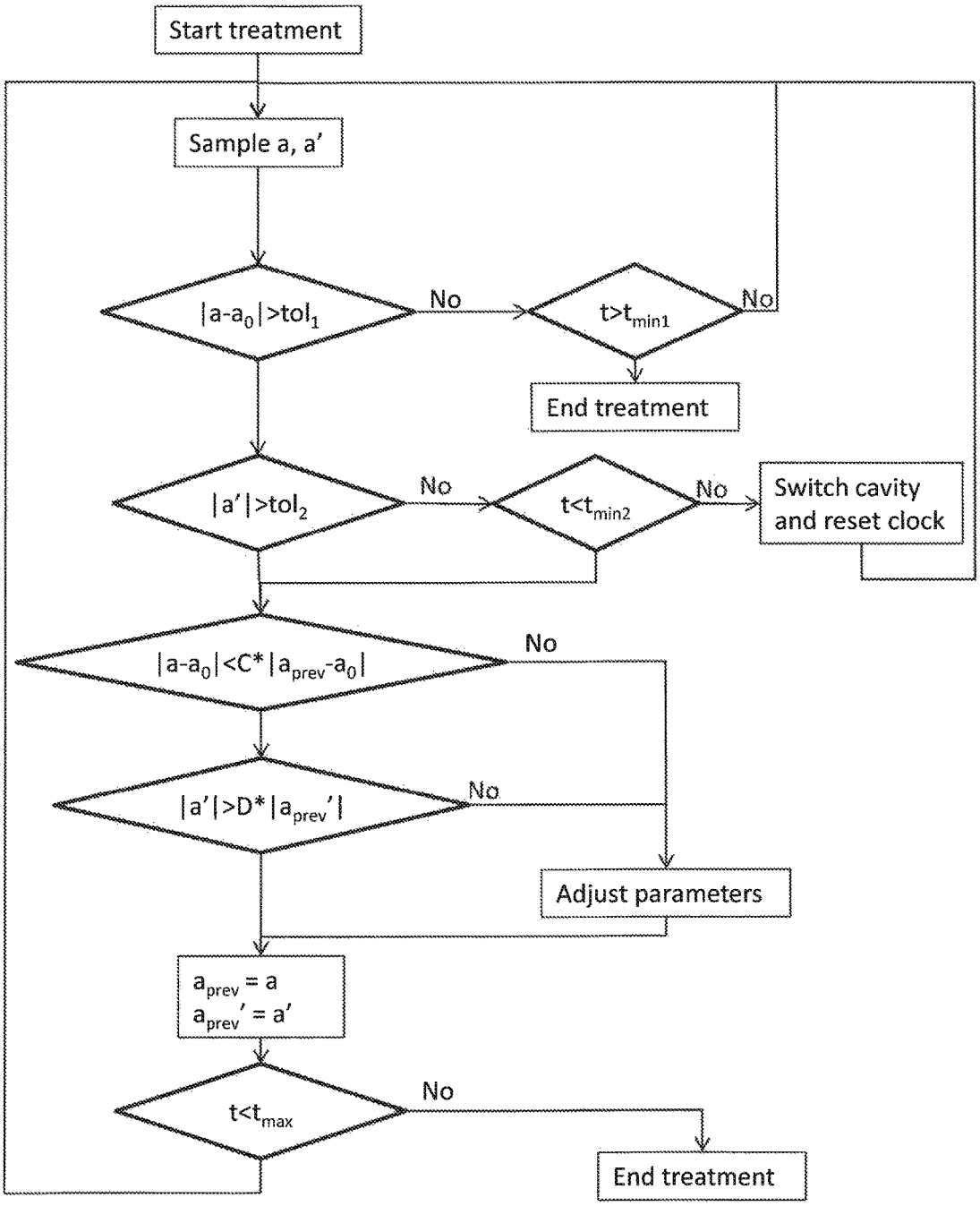

In FIG. 7D, another example of a stimulation procedure is showed. An input signal reflecting a measure of hypothalamic activity (a) is collected and its time derivative (a') is calculated. Similarly to the procedure in FIG. 7C, the absolute value of the difference between the activity measure (a) and a desired activity ($a_0$) is compared to a first threshold ($tol_1$), and if it does not exceed $tol_1$, stimulation is terminated provided that the first minimum stimulation time ($t_{min1}$) has been reached. If it does exceed $tol_1$, the absolute value of a calculated time derivative (a') of the activity measure (a) is compared to a second threshold ($tol_2$). Should the absolute value of a calculated time derivative (a') not exceed the second threshold threshold ($tol_2$) and a second minimum stimulation time ($t_{min1}$) has been reached, then the stimulation is terminated in a first nasal cavity and continued in a second nasal cavity while resetting the clock. Otherwise, the absolute value $|a-a_0|$ is compared to the absolute value of the difference between a previous activity ($a_{prev}$) measure and the desired rev level of activity ($a_0$) multiplied by the constant C, ($C*|a_{prev}-a_0|$). If the absolute value $|a-a_0|$ is larger than $C*|a_{prev}-a_0|$, the stimulation parameters should be adjusted since $|a-a_0|$ the activity measure is changing in the wrong direction. If the absolute value $|a-a_0|$ is smaller than $C*|a_{prev}-a_0|$, then the activity measure is changing in the desired direction and the time derivatives of the current and previous activity measures are compared. The constant C constitutes one example of a threshold tolerance as defined herein. When $|a'|$ is not larger than $D*|a_{prev}'|$, wherein D is a constant, the stimulation parameters should be adjusted since the activity measure is not changing fast enough. When $|a'|$ is larger than $|a_{prev}'|$, another stimulation cycle may be initiated. However, before initiating the next cycle, the current activity measure, as well as its derivative, replaces the previous activity measure, as well as its derivative. In addition, another cycle may only be continued if the maximum stimulation time has not been reached. If the maximum stimulation time is reached, stimulation is terminated.

Clinical Results

Materials and Methods

Pilot tests were conducted with a device and a method according to the invention. The tests were conducted in the nasal cavity of patients with diseases associated with the activity of hypothalamus.

The stimulation member was a balloon which in an expanded, second state had a diameter of approximately 1.5 cm and a length of 5 cm. The balloon was connected with a tubing having a length of approximately 15 cm. The tubing and the balloon were connected to each other such that one end of the tubing resided within the balloon, having a length of maximally 4 cm to simplify introduction into the nasal cavity. The tubing supplied air to the balloon for expanding the same. The other end of the tubing was connected via a three-way cock to a graduated syringe (20 ml) as well as to another tubing, which was connected to a closed air system. The closed air system was connected to a flexible membrane, which was oscillated with a variable frequency in the interval 10-100 Hz by means of a motor. The air pressure could be varied in a controlled manner within a pressure interval of 70-120 mbar. The amplitude of the oscillating membrane could be varied in a controlled manner (in arbitrary but reproducible units). Prior to use, the balloon was provided with a hygienic protective cover, consisting of a finger from a disposable glove. The hygienic protective cover was dipped in a paraffin solution prior to each introduction into a nasal cavity.

The following general method was used for all treatments:

The device in a first state with the balloon and its hygienic protective cover in a non-expanded state was introduced into the nasal cavity. Inside the nasal cavity, the balloon was expanded to a pressure of 70-120 mbar. By arranging and expanding the balloon in the nasal cavity in this way, a contact surface with the tissue of the posterior part of the nasal cavity was established.

Vibrations in the range of 40-100 Hz were achieved by varying the volume in the closed system by controlled movements of the flexible membrane by means of the motor.

The air was then evacuated from the balloon such that the balloon was transferred to a non-expanded state. The balloon was withdrawn from the nasal cavity, and the hygienic protective cover was removed.

If stimulation was conducted in the second nasal cavity as well, a new protective cover, dipped in paraffin solution, was placed over the balloon prior to introduction into the second nasal cavity. Stimulation was performed in the second nasal cavity according to the method above.

The results for the various groups of patients and individuals are described below.

Hypothalamic Stimulation of One Patient Suffering from Migraine

Treatment was performed while registering blood oxygen level dependent functional magnetic resonance images (fMRI). The patient estimated the pain before, during and after stimulation on a visual analogue scale (VAS) from 0-10, wherein 0 corresponds to no pain, and 10 corresponds to maximal pain.

Before treatment, the patient had vomited and was experiencing photophobia and nausea. The patient reported a pain level of 10 on the VAS scale. The pain was located to the right part of the head.

The patient was treated while in a horizontal position. The vibratory treatment was started in the right nasal cavity at a pressure of 85-100 mbar. The frequency was set to 68 Hz. After 10 minutes of treatment, the pain level was down to 6 and the nausea was gone. At that point the balloon was moved to the left nasal cavity and treatment continued for another 8 minutes. At this point the patient reported a pain level of 2. After a five minute break the treatment was started again in the right nasal cavity. After about 8 minutes the pain level was down to 1 and the treatment was terminated.

Six months after the treatment the patient reported that no migraine attacks had occurred. Consequently, the effect of the stimulation was long-lasting.

Analysis of the fMRI data showed that the oxygen consumption in the hypothalamus initially was abnormally high whereas during the treatment the consumption decreased to levels similar to the surrounding brain tissue.

Hypothalamic Stimulation of Patients Suffering from ALS

Two patients suffering from ALS have been treated with vibration therapy according to the present invention.

Treatment was conducted by administering vibrations at a frequency of 68 Hz to the nasal cavity. Vibration stimulation was conducted for a period of 10-12 minutes for each nasal cavity. The abutting pressure was 90-100 mbar.

Both patients reported improvements in their conditions. One patient has, after several treatment sessions according to the above description, once again been able to sneeze. The patient had not been able to sneeze for several months prior to the treatment due to the disease. The other patient reported reduced muscle contractions (fasciculations) during day time. Three weeks after the treatment the patient further reported that it is now possible to walk much further than previously and that a sense of numbness in the legs had decreased. Since there is no known way to cure or even slow down ALS these results are noteworthy.

Hypothalamic Stimulation of One Patient Suffering from Ménière's Disease

The patient has suffered from Ménière's disease affecting the left ear for about five years. Pharmacologic treatment has been unsuccessful and the suffering has reached a degree where the left ear is classified as deaf. The patient has been referred to destructive surgery.

Before the first treatment an audiogram was registered showing an average value of 70 dB for the left ear.

During a first treatment vibrations were administered to the left nasal cavity for about 11 minutes at a frequency of 74 Hz, and subsequently to the right nasal cavity for about the same period of time. During treatment of the right nasal cavity, the frequency was lowered to 68 Hz. Finally, the left nasal cavity was treated for about 11 minutes at 68 Hz. The pressure was in the range of 90-100 mbar.

A few days after the first treatment another audiogram measurement was performed showing that the patient's hearing on the left side had improved to an average value of 60 dB. The patient also reported that other ailments, e.g. a sensation of fullness in the ear and tinnitus, had been reduced.

One week after the first treatment a second treatment was conducted. Vibrations were administered to the right nasal cavity for 12 minutes followed by treatment in the left nasal cavity for 24 minutes. The pressure exerted in the nasal tissue was in the range of 90-100 mbar and the frequency was set to 68 Hz. The pressure was manually adjusted during the later stages of the treatment to investigate any change in patient response.

A few days later the patient's hearing was assessed again. This time the average value for the left ear was 53 dB. Thus, vibration stimulation with a device according to the present invention improved the hearing for the patient.

Hypothalamic Stimulation of One Patient Suffering from Heart Arrhythmia

One patient suffering from the most common form of heart arrhythmia, i.e. atrial fibrillation, was treated with a device and method according to the general description above. The patient, who has been suffering from heart arrhythmia for two years, had previously been treated with pharmaceuticals and electrical shock therapy on seven occasions. Neither of the therapies was successful. The patient has therefore been referred to ablation, which is a partly destructive procedure.

The patient was treated with vibration stimulation at four occasions with 2, 6, and 15 weeks in between. Vibration stimulation was performed in both nasal cavities. The pressure exerted on the tissue was in the range of 90-100 mbar and the frequency was 68 Hz. Vibration stimulation was conducted for 10 to 12 minutes in each nasal cavity.

During the last 15 weeks interval between the treatments, the patient was able to do physical exercise for the first time in two years. This indicates that the vibration stimulation method according to the present may improve the health condition for patients suffering from heart arrhythmia.

CONCLUSION

The patients treated according to the above description have responded well to a stimulation frequency of 68 Hz.

It is not evident what bodily function a particular frequency corresponds to. One possibility would be that any particular frequency or higher harmonics of it correspond to an intrinsic frequency of the mechanoreceptors. Another alternative is that parts of the bone structure where the mechanoreceptors are attached have a resonance that is excited by the applied vibrations. Yet another possibility is that vibrations of the hypothalamus itself or some surrounding tissue at this particular frequency has a beneficial effect.

What is claimed is:

1. A method for stimulating the hypothalamus in a human subject, comprising:

imparting vibrations to a posterior part of a nasal cavity of the human subject;

obtaining an input signal reflecting a measure of hypothalamic activity; and storing consecutive time samples of said input signal together with at least one of a frequency of the vibrations imparted to the posterior part of the nasal cavity, an amplitude of the vibrations imparted to the posterior part of the nasal cavity, and a pressure exerted on a tissue of the posterior part of the nasal cavity;

comparing the input signal with a previously obtained time sample;

adjusting at least one of frequency, amplitude and pressure, if a difference between a later obtained value of the input signal and the previously obtained value lies within a threshold tolerance;

determining if the input signal is approaching a desired value reflecting a desired level of hypothalamic activity, said determination comprising comparing the difference between the input signal and the desired value with the difference between the previous time sample and the desired value; and if it is determined that the desired value is not approached, adjusting at least one of the frequency, the amplitude and the pressure, wherein said adjusting is performed using a method selected from:

a random adjustment;

an adjustment calculated by applying a heuristic search;

an adjustment calculated from a look-up table comprising correlations between desired activity level changes and at least one of frequency, amplitude, and pressure; and an adjustment calculated by identifying correlations between changes in the stored time samples and changes in the stored at least one of frequency, amplitude, and pressure, wherein the step of imparting vibrations comprises the steps of a) providing a device comprising:

an expandable stimulation member arranged to stimulate hypothalamic activity by imparting vibration to the posterior part of the nasal cavity;

an expansion member arranged to expand the stimulation member, the expansion member comprises:

a tubular structure arranged at least partly within the stimulation member, wherein the tubular structure is provided with a plurality of openings arranged for fluid communication with the stimulation member; having a bending stiffness in a first direction essentially perpendicular to a longitudinal direction of the tubular structure, being different from a bending stiffness in a second direction essentially perpendicular both to the first direction as well as to the longitudinal direction of the tubular structure; and a vibration member connected to the expansion member and arranged to bring the expandable stimulation member to vibrate;

b) introducing the stimulation member in an essentially non-expanded state into the posterior part of the nasal cavity of the human subject;

c) expanding the stimulation member such as to exert a pressure on a surrounding tissue in the posterior part of the nasal cavity; and d) bringing the stimulation member to vibrate in the posterior part of the nasal cavity.

2. The method according to claim 1, further comprising the step of exerting a pressure of between approximately 70 and 120 mbar on the tissue of the posterior part of the nasal cavity.

3. The method according to claim 1, further comprising the step of terminating the vibratory stimulation in the posterior part of the nasal cavity when the input signal reflecting a measure of hypothalamic activity has reached a first threshold.

4. The method according to claim 3, wherein the nasal cavity is a first nasal cavity, said method further comprising the step of imparting vibrations to a posterior part of a second nasal cavity of the human subject when the input signal reflecting a measure of hypothalamic activity has reached a second threshold for stimulation in the first nasal cavity.

5. The method according to claim 1, further comprising the step of terminating stimulation when a maximum time period has elapsed.

6. The method according to claim 1, further comprising the step of obtaining an input signal reflecting a measure of hypothalamic activity by functional neuroimaging.

7. The method according to claim 6, wherein the input signal reflecting a measure of hypothalamic activity is selected from the group consisting of oxygen consumption as measured by fMRI, metabolic activity as measured by PET, magnetic signals as measured with MEG, and electrical signals as measured with EEG.

8. The method according to claim 1, further comprising the step of obtaining an input signal reflecting a measure of hypothalamic activity, wherein the input signal is selected from the group consisting of heart rate, pupil size, body temperature, pain sensation and blood pressure.

9. The method according to claim 1, further comprising the step of selecting a treatment area in the posterior part of the nasal cavity and imparting vibrations to the selected treatment area.

10. The method according to claim 1, further comprising the steps of: bringing the stimulation member to an essentially non-expanded state; removing the stimulation member from the nasal cavity; and repeating the steps b)-d) in a second nasal cavity of the human subject.

11. The method according to claim 1, further comprising the step of imparting vibrations at at least one frequency selected from the range of approximately 60 to 70 Hz.

12. The method according to claim 1, further comprising the step of exerting an average pressure of between approximately 90 mbar and approximately 105 mbar on the tissue of the posterior part of the nasal cavity.

13. The method according to claim 1, wherein the expandable stimulation member further comprises a stimulating portion arranged to abut against the tissue of the posterior part of the nasal cavity; and a retaining portion arranged to abut against the tissue of the anterior part of the nasal cavity.

14. The method according to claim 1, wherein the expansion member further comprises an elongated structure arranged in fluid communication with the tubular structure, wherein the elongated structure is arranged outside the stimulation member.

15. The method according to claim 1, wherein the human subject suffers from a disease selected from the group containing Meniere's disease, hypertension, arrhythmia, ALS, irritable bowel syndrome, sleep disorders, diabetes, obesity, Alzheimer's disease, mood and anxiety disorders and epilepsy.

16. The method according to claim 1, further comprising the step of imparting vibrations at at least one frequency selected from the range of approximately 40 to 100 Hz.

17. The method according to claim 16 further comprising the step of imparting vibrations at at least one frequency selected from the range of approximately 60 to 70 Hz.

* * * * *